US011430644B2

(12) United States Patent
Schmitt et al.

(10) Patent No.: US 11,430,644 B2
(45) **Date of Patent: *Aug. 30, 2022**

(54) SYSTEM AND METHOD FOR THERMIONIC ENERGY CONVERSION

(71) Applicant: Spark Thermionics, Inc., Berkeley, CA (US)

(72) Inventors: Felix Schmitt, Berkeley, CA (US); Jared William Schwede, Berkeley, CA (US); Adam Lorimer, Berkeley, CA (US)

(73) Assignee: Spark Thermionics, Inc., Berkeley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/883,762

(22) Filed: May 26, 2020

(65) Prior Publication Data

US 2020/0321203 A1 Oct. 8, 2020

Related U.S. Application Data

(63) Continuation of application No. 16/676,131, filed on Nov. 6, 2019, now Pat. No. 10,699,886.

(60) Provisional application No. 62/915,160, filed on Oct. 15, 2019, provisional application No. 62/756,502, filed on Nov. 6, 2018.

(51) Int. Cl.
*H01J 45/00* (2006.01)

(52) U.S. Cl.
CPC ..... *H01J 45/00* (2013.01)

(58) Field of Classification Search
CPC ..... G21H 1/10; G21H 1/103; G21H 1/106; H01J 45/00; H02N 3/00
USPC ..... 310/300, 306
See application file for complete search history.

(56) References Cited

U.S. PATENT DOCUMENTS

| | | | |
|---|---|---|---|
| 3,155,849 | A | 11/1964 | Lawrence et al. |
| 3,201,618 | A | 8/1965 | Coleman |
| 3,477,012 | A | 11/1969 | Laing |
| 3,482,120 | A | 12/1969 | Wilson |

(Continued)

FOREIGN PATENT DOCUMENTS

| | | | |
|---|---|---|---|
| CA | 2367686 | A1 | 10/2000 |
| CN | 204285609 | U | 4/2015 |

OTHER PUBLICATIONS

Lucas R. Meza, "Strong, lightweight, and recoverable three-dimensional ceramic nanolattices", Sep. 12, 2014 • vol. 345 Issue 6202.

(Continued)

*Primary Examiner* — Thomas Truong
(74) *Attorney, Agent, or Firm* — Jeffrey Schox; Samuel Rosenthal

(57) ABSTRACT

A system for thermionic energy generation, preferably including one or more thermionic energy converters, and optionally including one or more power inputs, airflow modules, and/or electrical loads. A thermionic energy converter, preferably including an emitter module, a collector module, and/or a seal, and optionally including a spacer. The thermionic energy converter preferably defines a chamber and/or a heating cavity. A method for thermionic energy generation, preferably including receiving power, emitting electrons, and/or receiving the emitted electrons, and optionally including convectively transferring heat.

20 Claims, 13 Drawing Sheets

(56) References Cited

U.S. PATENT DOCUMENTS

| | | | | |
|---|---|---|---|---|
| 3,740,592 | A * | 6/1973 | Engdahl | H01J 45/00 310/306 |
| 3,843,896 | A | 10/1974 | Rason et al. | |
| 3,932,776 | A | 1/1976 | Dunlay et al. | |
| 5,495,829 | A | 3/1996 | Jayaraman et al. | |
| 10,546,990 | B2 | 1/2020 | Schwede et al. | |
| 2008/0061158 | A1 | 3/2008 | Nakagawa et al. | |
| 2010/0019619 | A1 | 1/2010 | Hagg | |
| 2012/0299438 | A1 | 11/2012 | Kimura et al. | |
| 2014/0306575 | A1 | 10/2014 | Paxton et al. | |
| 2017/0016631 | A1 | 1/2017 | Shaffer | |
| 2019/0027347 | A1 | 1/2019 | Schwede et al. | |
| 2020/0119249 | A1 | 4/2020 | Schwede et al. | |
| 2020/0321203 | A1 | 10/2020 | Schmitt et al. | |

OTHER PUBLICATIONS

Martini, W. R. "Internal flame-heated thermionic converters." In Thermionic specialist conference, p. 356. 1963.

T. A. Schaedler, "Ultralight Metallic Microlattices", Nov. 18, 2011 vol. 334 Science www.sciencemag.org.

* cited by examiner

SYSTEM AND METHOD FOR THERMIONIC ENERGY CONVERSION

CROSS-REFERENCE TO RELATED APPLICATIONS

This application is a continuation of U.S. patent application Ser. No. 16/676,131, filed 6 Nov. 2019, which claims the benefit of U.S. Provisional Application Ser. No. 62/756,502, filed on 6 Nov. 2018, and of U.S. Provisional Application Ser. No. 62/915,160, filed on 15 Oct. 2019, each of which is incorporated in its entirety by this reference.

STATEMENT OF GOVERNMENT SUPPORT

This invention was made with government support under Contract Numbers W911-NF-17-P-0034 and W911NF-18-C-0057 awarded by the Defense Advanced Research Projects Agency. The government has certain rights in the invention.

TECHNICAL FIELD

This invention relates generally to the thermionic energy conversion field, and more specifically to a new and useful system and method for thermionic energy conversion.

BACKGROUND

Typical thermionic energy converters (TECs) can suffer from limited power conversion efficiency, especially when accounting for efficiency losses associated with delivering heat to the TEC. Thus, there is a need in the thermionic energy conversion field to create a new and useful system and method for thermionic energy conversion.

DESCRIPTION OF THE PREFERRED EMBODIMENTS

The following description of the preferred embodiments of the invention is not intended to limit the invention to these preferred embodiments, but rather to enable any person skilled in the art to make and use this invention.

1. System.

Figure 1A:
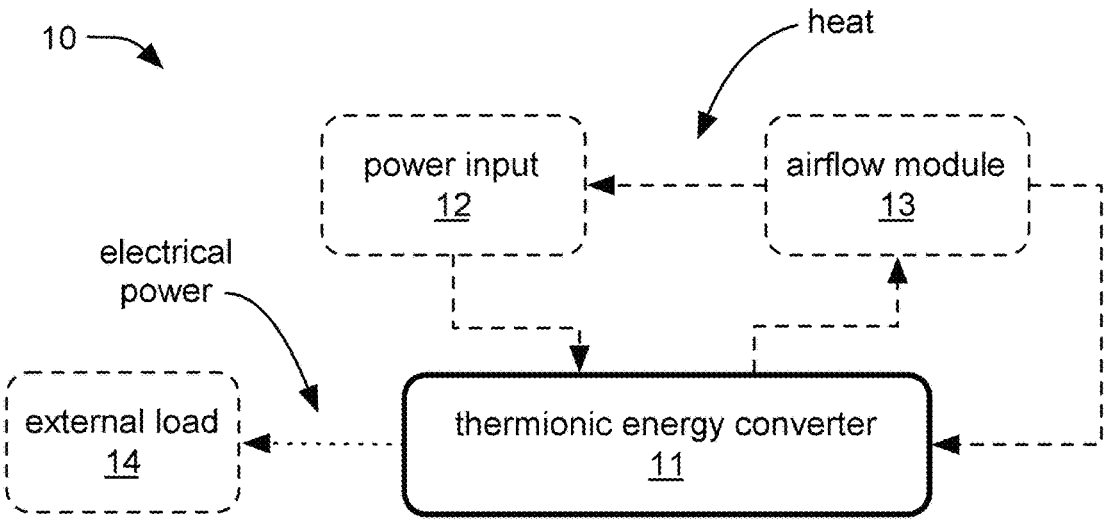
FIG. 1A is a schematic representation of an embodiment of a system for thermionic energy generation.
Figure 1B:
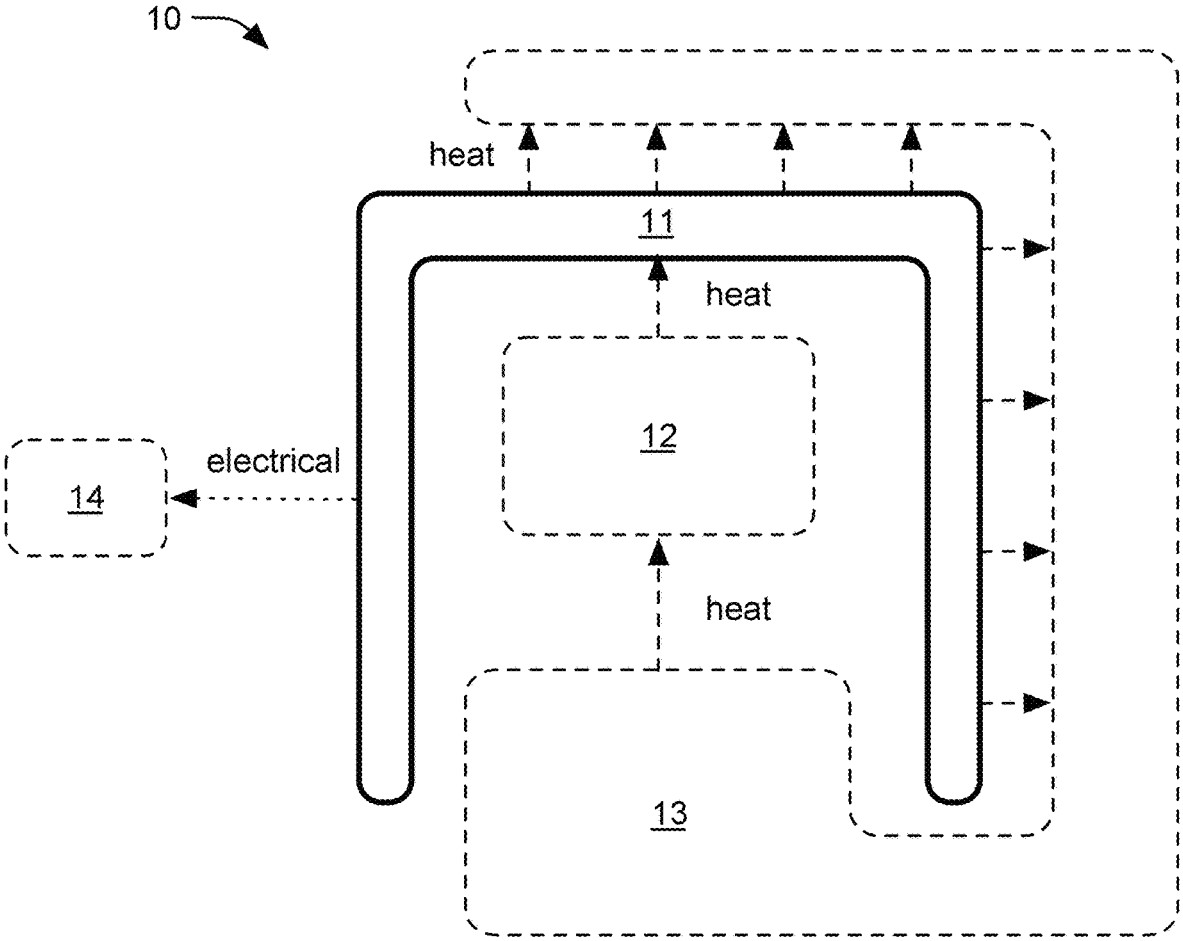
FIG. 1B is a schematic representation of a variation of the system.
Figure 2A:
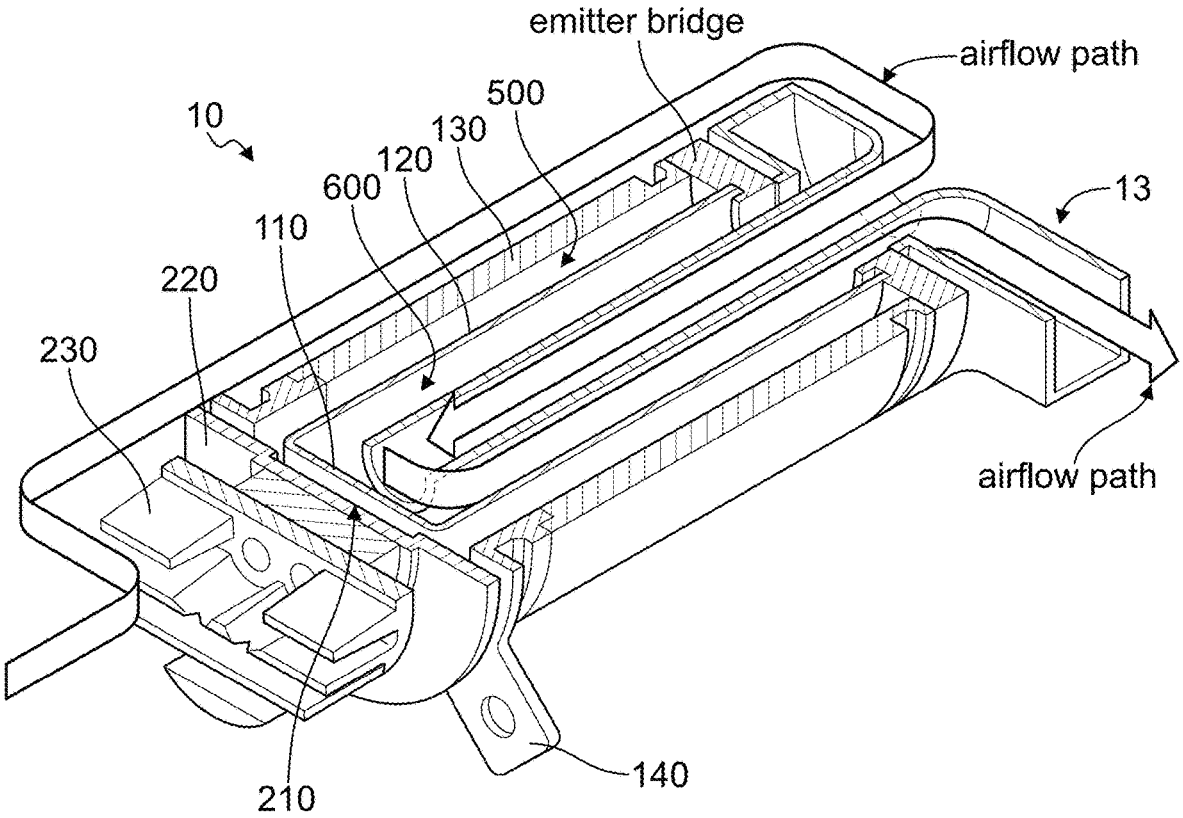
FIGS. 2A-2C are cross-sectional views of a first, second, and third specific example of the system, respectively.

A system 10 for thermionic energy generation preferably includes one or more thermionic energy converters 11 (TECs). The system can optionally include one or more power inputs 12, airflow modules 13, and/or electrical loads 14 (e.g., as shown in FIGS. 1A, 1B, 2A, and/or 2B). However, the system can additionally or alternatively include any other suitable elements.

1.1 Thermionic Energy Converter.

Figure 3A:
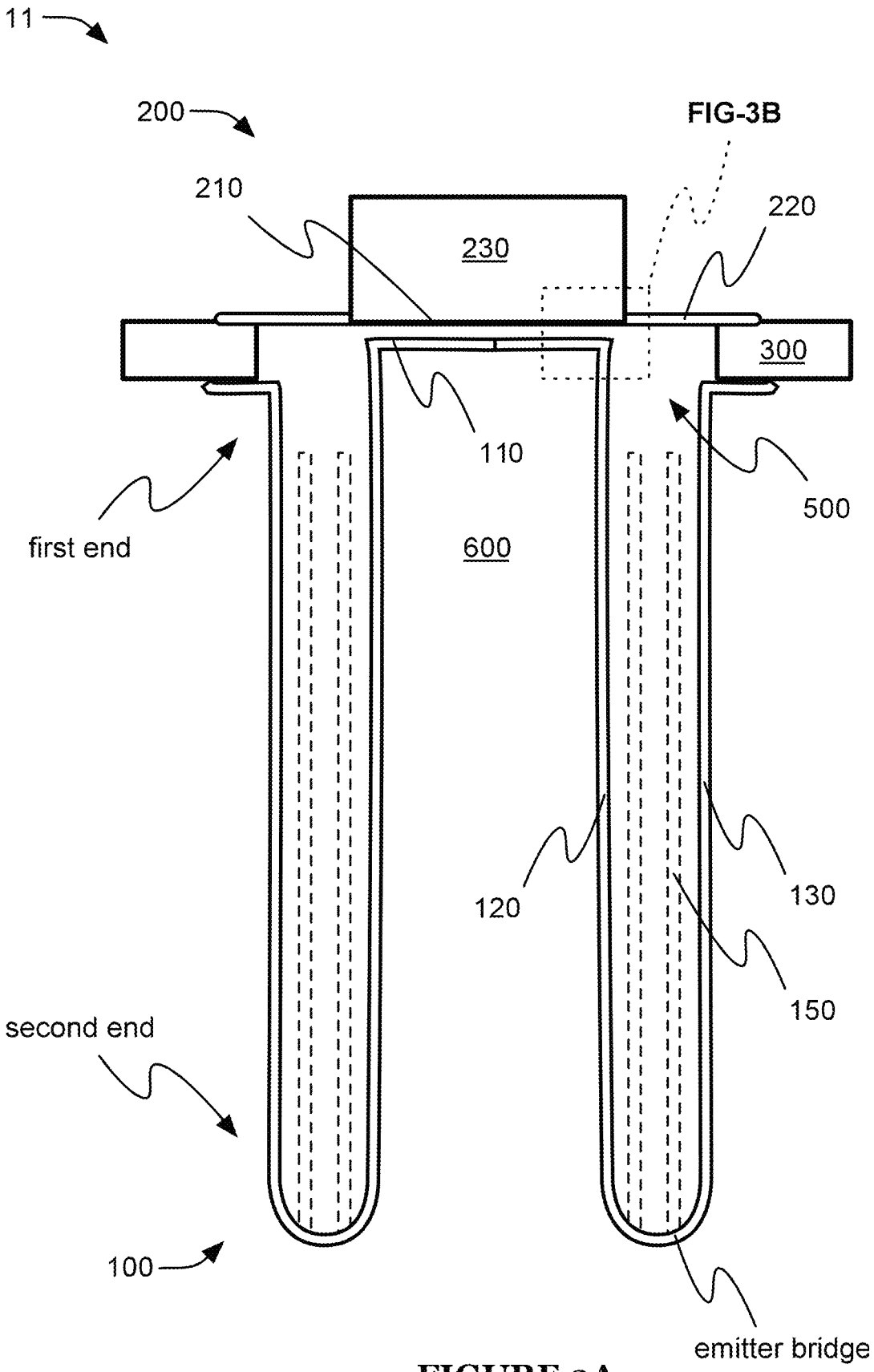
FIG. 3A is a schematic representation of a cross-sectional view of an example of a TEC of the system.
Figure 3B:
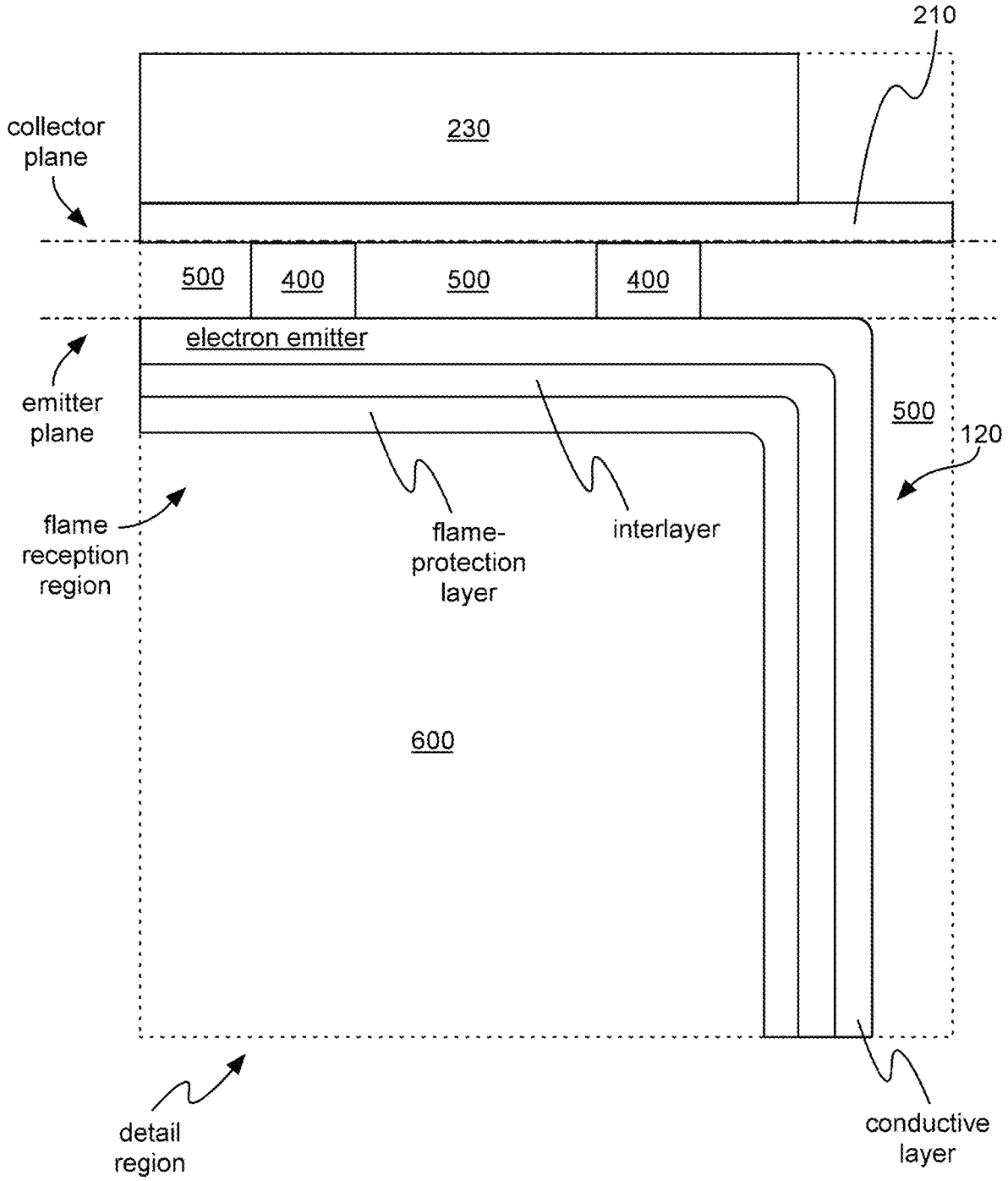
FIG. 3B is a detail view of a specific example of a portion of the TEC of FIG. 3A.

The thermionic energy converter 11 (TEC) preferably functions to convert a heat input into an electrical power output. The TEC preferably includes an emitter module 100, a collector module 200, and a seal 300 (e.g., as shown in FIGS. 3A-3B). The TEC can optionally include a spacer 400. However, the TEC can additionally or alternatively include any other suitable elements.

The TEC preferably defines a chamber 500. The chamber is preferably defined by the inner walls of the emitter module, collector module, and/or seal (e.g., wherein the inner walls define a boundary of the chamber). The chamber is preferably fluidly isolated from an ambient environment surrounding the TEC (e.g., atmospheric air). The chamber environment is preferably at a reduced pressure (e.g., full or partial vacuum) compared to the ambient environment. The chamber can enclose one or more species (e.g., barium, cesium, oxygen, sodium, strontium, zirconium, etc.). However, the chamber can additionally or alternatively have any other suitable properties.

The TEC preferably defines a heating cavity 600. The heating cavity is preferably defined by a portion of the wall of the emitter module (e.g., outer wall of the inner shell). The heating cavity is preferably open to the ambient environment (e.g., open at one end), but can alternatively be an enclosed cavity and/or any other suitable cavity. However, the heating cavity can additionally or alternatively have any other suitable properties.

The TEC can optionally include one or more elements such as described in U.S. patent application Ser. No. 15/969,027, filed 2 May 2018 and titled "SYSTEM AND METHOD FOR WORK FUNCTION REDUCTION AND THERMIONIC ENERGY CONVERSION", and/or U.S. patent application Ser. No. 16/044,215, filed 24 Jul. 2018 and titled "SMALL GAP DEVICE SYSTEM AND METHOD OF FABRICATION", each of which are herein incorporated in their entireties by this reference. For example, the emitter module can include the 'cathode 200' (or elements thereof) of U.S. patent application Ser. No. 15/969,027, the collector module can include the 'anode 100' (or elements thereof) of U.S. patent application Ser. No. 15/969,027, and/or the spacer can include the 'spacers 120' (or elements thereof) of U.S. patent application Ser. No. 16/044,215.

However, the TEC can additionally or alternatively include any other suitable elements in any suitable arrangement.

1.1.1 Emitter Module.

The emitter module 100 preferably functions to receive heat (e.g., from the power input) and emit electrons (e.g., into the chamber). The emitter module preferably includes one or more electron emitters 110, an inner shell 120, and/or an outer shell 130 (which can additionally or alternatively be part of the collector module and/or be a separate element of the TEC), such as shown by way of examples in FIGS. 3A, 3B, and/or 4-6. The emitter module can optionally include one or more electrical leads 140 and/or radiation shields 150. However, the emitter module can additionally or alternatively include any other suitable elements.

The electron emitter (i.e., cathode) preferably contains (e.g., is, consists essentially of, etc.) one or more metals, preferably refractory metals such as tungsten, tantalum, rhenium, ruthenium, molybdenum, nickel, chromium, one or more superalloys (e.g., Inconels, Hastelloys, Kanthals, etc.), niobium, platinum, rhodium, iridium, etc. However, the electron emitter can additionally or alternatively include one or more semiconductor materials, insulating materials, and/or any other suitable materials. The electron emitter can be a deposited layer (e.g., deposited via chemical vapor deposition, physical vapor deposition, spray deposition, electrodeposition, etc.), can be a bulk material, and/or can be fabricated in any other suitable manner.

The electron emitter preferably coats the interior (e.g., inner wall, such as the wall most proximal the chamber) of a portion of the inner shell, more preferably wherein the electron emitter is arranged facing the electron collector across the chamber (e.g., wherein the electron emitter coats the portion of the inner shell that faces the electron collector across the chamber). The portion is preferably part of and/or near the flame-reception region of the inner shell, and preferably intersects and/or is centered along a central axis (e.g., central axis defined by the emitter module, such as a central axis of the heating cavity). However, the electron emitter can additionally or alternatively be arranged in any other suitable location.

The electron emitter is preferably conductively connected to other elements of the emitter module, such as to the inner shell (e.g., to a conductive layer of the inner shell), the outer shell (e.g., connected via the inner shell), and/or the emitter lead (e.g., preferably via the outer shell, alternatively via the inner shell, and/or any other suitable elements). However, the electron emitter can additionally or alternatively be conductively connected (and/or otherwise electrically coupled) to any other suitable elements of the emitter module and/or of the system.

The electron emitter is preferably thermally coupled to the inner shell, more preferably to the flame-reception region of the inner shell (e.g., wherein the electron emitter is heated by the inner shell). However, the electron emitter can additionally or alternatively be thermally coupled to any other suitable elements of the system.

The electron emitter preferably includes a substantially planar surface (e.g., defining an emitter plane) that preferably bounds the chamber, but can additionally or alternatively include surfaces of any other suitable confirmations.

However, the electron emitter can additionally or alternatively have any other suitable properties.

The inner shell of the emitter module preferably includes a multi-layer structure. For example, the inner shell can include a flame-protection layer (FPL), a conductive layer, and/or an interlayer (e.g., as shown in FIGS. 3B and/or 5). However, the inner shell can additionally or alternatively include any other suitable layers and/or other elements. The interfaces between layers of the inner shell can be smooth, rough, graded, interdiffused, and/or have any other suitable properties. In some embodiments, the layers of the inner shell (or a subset thereof) do not define discrete interfaces, but rather change substantially smoothly in composition from one layer to the next. The inner shell preferably has an overall thickness in the range 0.05-10 mm, preferably 0.2-4 mm (e.g., 0.2-0.5, 0.5-2, 2-4, 0.5-1, or 1-2 mm, etc.).

The FPL preferably functions to protect other elements of the inner shell (and/or other elements of the emitter module, such as the electron emitter) from the flame in the heating cavity. The FPL is preferably arranged proximal (e.g., bounding) the heating cavity. The FPL can include (e.g., be made of, consist essentially of, etc.) aluminum oxide, silicon dioxide, boron trioxide, mullite, platinum, rhodium, iridium, silicon, silicides such as molybdenum disilicide, silicon carbide, silicon nitride, Hitemco R512E, stainless steel, nickel, chromium, one or more superalloys (e.g., Inconels, Hastelloys, Kanthals, etc.) and/or any other suitable materials. In some examples, the FPL has a thickness in the range 0.0005-10 mm (e.g., 0.0005-0.002, 0.002-0.005, 0.005-0.01, 0.01-0.02, 0.02-0.05, 0.05-0.02, 0.02-3, 3-10, 0.02-0.1, 0.1-0.3, 0.3-0.5, 0.5-1, 1-2, and/or 2-5 mm, etc.). However, the FPL can additionally or alternatively have any other suitable properties.

The conductive layer is preferably arranged proximal (e.g., bounding) the chamber (e.g., opposing the heating cavity across the FPL). The conductive layer is preferably electrically conductive. The conductive layer can be contiguous with the electron emitter (e.g., can be part of the same material layer as the electron emitter wherein the conductive layer and electron emitter cooperatively form a single layer, such as a single metal layer). The conductive layer preferably functions to electrically connect the electron emitter to one or more other elements of the emitter module, such as to the outer shell. In some examples, the conductive layer has one or more properties substantially similar to the properties of the FPL (and/or to properties such as described above regarding possible embodiments of the FPL), such as having substantially the same composition and/or thickness as the FPL. However, the conductive layer can additionally or alternatively have any other suitable properties.

The inner shell can optionally include an interlayer (or multiple interlayers). The interlayer can function as a diffusion barrier (e.g., reducing diffusion between the FPL and the conductive layer, and/or between any other suitable layers or regions of the inner shell), bonding layer (e.g., adhering to and/or improving adhesion between other layers of the inner shell, such as the FPL and/or conductive layer, etc.). The interlayer can include (e.g., be made of, consist essentially of, etc.) aluminum oxide, silicon dioxide, boron trioxide, titanium oxide, mullite, silicon, silicides such as molybdenum disilicide, silicon carbide, silicon nitride, zirconium diboride, graphite, carbon composites and/or other carbon-containing materials (e.g., carburized materials), niobium carbide, hafnium carbide, tantalum carbide, zirconium carbide, tantalum nitride, aluminum nitride, titanium nitride, nickel, one or more superalloys, and/or any other suitable materials. In examples, the interlayer thickness can be in the range 0.0005-10 mm (e.g., 0.0005-0.001, 0.001-0.002, 0.002-0.005, 0.005-0.02, 0.02-0.5, 0.5-2, 0.02-0.05, 0.05-0.1, 0.1-0.2, 0.2-0.5, 0.5-1, 1-2, 2-5, or 5-10 mm, etc.), but can additionally or alternatively be thicker, thinner, and/or have any other suitable dimensions. However, the interlayer can additionally or alternatively have any other suitable properties.

The inner shell preferably includes a planar (or substantially planar) portion and/or one or more sidewalls (e.g., as shown in FIGS. 3A and/or 4). The planar portion is preferably substantially parallel the emitter plane (e.g., wherein the electron emitter is affixed to and/or deposited on the planar portion), but can alternatively have any other suitable arrangement. The sidewalls are preferably straight sidewalls.

The sidewalls are preferably arranged opposing the emitter plane across the planar portion of the inner shell (and/or opposing the electron collector across the chamber and/or across the electron emitter). The sidewalls preferably extend from a first inner shell sidewall end proximal the planar portion to a second inner shell sidewall end. The sidewalls can extend substantially normal to the planar portion and/or to the emitter plane, at an oblique angle (e.g., within a threshold angle of perpendicular, such as within 1, 2, 3, 5, 10, 15, 20, 25, or 30° of perpendicular, etc.) to the planar portion and/or to the emitter plane, and/or extend in any other suitable direction(s). In some embodiments, the inner shell includes one or more bridging features, such as chamfers and/or bevels, at and/or near the first inner shell sidewall end (e.g., between the sidewall and the planar portion). The sidewalls preferably define a reference axis, such as a longitudinal axis (e.g., substantially normal to the planar portion and/or emitter plane, intersecting the electron emitter and/or electron collector, etc.) about which the sidewalls are substantially centered (e.g., wherein the sidewalls are rotationally symmetric about the longitudinal axis, such as having 2-, 3-, 4-, 6-, or 8-fold rotational symmetry about the longitudinal axis, higher-order rotational symmetry about the longitudinal axis, circular symmetry about the longitudinal axis, etc.). However, the sidewalls can additionally or alternatively have any other suitable properties.

In one example, the inner shell includes a planar portion defining a substantially circular region (e.g., centered on the electron emitter). In a first specific example (e.g., in which the sidewalls extend substantially normal the planar portion and/or emitter plane), the inner shell includes a single sidewall defining a cylindrical shell, wherein the cylindrical shell defines a cylinder axis that preferably intersects and/or is substantially normal to the electron emitter and electron collector. In a second specific example (e.g., in which the sidewalls extend at an oblique angle to the planar portion and/or emitter plane), the inner shell includes a single sidewall defining a conical or frustoconical shell (e.g., frustum of a conical shell, preferably a right conical shell, terminated by the planar portion, emitter plane, or a reference plane substantially parallel the planar portion and/or emitter plane), wherein the cylindrical shell defines a cylinder axis that preferably intersects and/or is substantially normal to the electron emitter and electron collector In some examples, the inner shell can have a length (e.g., sidewall length) of 45-250 mm (e.g., 45-70, 55-65, 70-100, 100-140, 140-190, or 190-250 mm), 20-45 mm, or 250-750 mm. In some examples, the inner shell can have a width (e.g., planar portion width, such as planar portion diameter) of 10-30 mm, (e.g., 10-15, 15-20, 18-22, 20-25, or 25-30 mm), 5-10 mm, or 30-60 mm. However, the inner shell can have any other suitable shape and/or dimensions.

The inner shell preferably includes one or more heat-reception regions (e.g., flame-reception regions), which preferably function to receive a flame within the heating cavity (e.g., a flame incident upon the flame-reception region). The flame-reception region is preferably a portion of the FPL (and optionally of the interlayer and/or any other suitable elements of the inner shell). Although referred to herein as a flame-reception region, a person of skill in the art will recognize that the inner shell can additionally or alternatively include one or more heat-reception regions configured to receive heat (e.g., from the burner and/or other power output) in any suitable manner (e.g., via radiation, convection, and/or conduction), and that the heat-reception regions can include elements and/or have properties such as described herein regarding the flame-reception region, but can additionally or alternatively include any other suitable elements and/or have any other suitable properties.

The flame-reception region is preferably arranged between the electron emitter and the flame (e.g., between the electron emitter and the heating cavity). The electron emitter (and optionally some or all of the inner shell conductive layer) is preferably arranged between the flame-reception region and the chamber, and/or is preferably affixed to the flame-reception region (wherein one is formed by deposition onto the other). In some embodiments, the flame-reception region can include one or more fins and/or other heat transfer structures, which can function to increase heat transfer (e.g., from the flame to the flame-reception region). However, the flame-reception region can additionally or alternatively include any other suitable elements in any suitable arrangement.

One or more surfaces of the inner shell can be ground, lapped, and/or polished (e.g., electropolished), and/or can be otherwise smoothed, which can function to reduce thermal radiation from the surfaces. The surface(s) can additionally or alternatively be coated with one or more layers (e.g., thin layer) of low-emissivity material, which can also function to reduce thermal radiation. This can reduce heat loss (e.g., from the electron emitter, flame-reception region, and/or other inner shell elements) and/or can reduce heat transmission to other elements (e.g., to the outer shell, electron collector, and/or other collector module elements).

However, the inner shell can additionally or alternatively include any other suitable elements in any suitable arrangement.

The outer shell preferably functions to electrically connect to the inner shell and to mechanically and/or thermally couple (e.g., connect) the inner shell to the collector module. The outer shell preferably exhibits high thermal conduction and/or oxidation resistance (e.g., at elevated temperatures, such as at a temperature in the range 100-900° C., preferably 300-600° C.).

The outer shell preferably surrounds or substantially surrounds the inner shell (e.g., wherein the outer shell defines a portion of the chamber in cooperation with the inner shell that it surrounds). The inner and outer shells can define a gap (e.g., between the inner walls of the inner and outer shells) of substantially constant width, of varying width (e.g., tapering, from a wider gap at or near the first end, to a narrower gap or no gap at or near the second end), and/or with any other suitable properties. For example, the outer shell can define a second cylindrical shell preferably concentric with and of greater radius than the cylindrical sidewall of the inner shell. However, the outer shell can alternatively define any other suitable shape. The outer shell preferably has dimensions similar to those of the inner shell, such as having a substantially equal length and a slightly greater width than the inner shell (e.g., wherein the difference in width defines the gap width). The gap is preferably large enough to avoid thermal (and/or electrical) shorting between the inner and outer shells (e.g., due to sidewall roughness; due to materials associated with low work function coatings, such as droplets of Cs metal; etc.). In some examples, the gap (e.g., average gap, minimum gap, etc.) is greater than a threshold width (e.g., 0.01, 0.03, 0.1, 0.2, 0.5, or 1 mm, etc.), but can additionally or alternatively be less than 0.01 mm or have any other suitable width. For example, the gap can have a width in the range 0.2-20 mm (e.g., 1-10, 1-3, 3-6, 5-10, or 10-20 mm, etc.), but can additionally or alternatively be narrower (and/or be absent or substantially absent, such as wherein the gap reduces to zero at or near the second end, bridging the inner and outer shells) and/or wider. However, the gap width can additionally or alternatively be in the range 20-50 mm, 50-200 mm, or be greater than 200 mm. In some examples, the TEC includes one or more spacers, preferably thermally and/or electrically insulating spacers (e.g., insulating balls, such as sapphire balls), arranged within the chamber between the inner and outer shell sidewalls, which can function to maintain a desired minimum gap width. The outer shell preferably defines a first end and a second end, more preferably corresponding to the first and second ends of the inner shell, such as wherein the outer shell first end is proximal the inner shell first end (e.g., substantially opposing each other across the chamber), the outer shell second end is proximal the inner shell second end (e.g., substantially opposing each other across the chamber), and/or a direction from the outer shell first end to the outer shell second end is substantially aligned with a direction from the inner shell first end to the inner shell second end (e.g., wherein 'substantially aligned' means that an angle between the vectors is less than a threshold amount, such as 1°, 2°, 5°, 10°, 15°, 20°, 25°, 30°, 35°, 45°, 60°, 75°, or 90°; a dot product between the vectors is positive; etc.). However, the outer shell can alternatively have any other suitable shape and/or dimensions.

The outer shell preferably includes one or more thermally and/or electrically conductive elements (e.g., running the length of the outer shell, such as from the first end to the second end). In a first embodiment, the outer shell includes a substantially uniform wall (e.g., metal wall). In examples, the wall can include (e.g., be made of, consist essentially of, etc.) one or more of: nickel and/or nickel alloys (e.g., Monel, Kovar, Invar, Inovco, Alloy 42, such as FeNi42, NILO 42, Glass Seal 42, and/or Pernifer 40, etc.), aluminum, chromium, copper, stainless steel, titanium, and/or Hastelloy. The wall can optionally include one or more cladding layers (e.g., if the conductive wall material is not sufficiently oxidation resistant, such as for a copper or aluminum conductive wall material). The cladding layers can include an oxidation resistant layer (e.g., nickel, nickel alloy(s), chromium, stainless steel, etc.) and/or an interlayer, which can function as a diffusion barrier between the conductive wall material and the oxidation resistant layer. The interlayer is preferably arranged between the wall interior (e.g., the conductive wall material) and the oxidation resistant cladding layer. In one example, the interlayer includes cobalt. However, the interlayer can additionally or alternatively include any other suitable materials.

In a first example of this embodiment, the wall includes a copper core, a cobalt interlayer, and a nickel (or nickel alloy) oxidation resistant cladding layer. In a second example, the wall includes an aluminum core and a stainless steel oxidation resistant cladding layer. However, the wall can additionally or alternatively include any other suitable elements and/or materials in any suitable arrangement.

In a second embodiment, the outer shell includes one or more heat pipes (e.g. running between the first and second ends), which can function to carry heat along the length of the outer shell. The heat pipes preferably include a solid body enclosing a fluid that can carry heat by convection. In examples, the body can include one or more of the materials described above regarding the first embodiment (e.g., stainless steel, Monel, Hastalloy, etc.), and/or include any other suitable materials. In such examples, the fluid (e.g., a liquid and/or vapor at the temperature of the outer shell) can include tin, lead, sodium, cesium, potassium, and/or any other suitable materials. However, the outer shell can additionally or alternatively include any other suitable structures configured to carry heat and/or can alternatively omit such structures.

The inner shell and/or outer shell can optionally define an emitter bridge. The emitter bridge preferably connects the inner and outer shells (e.g., at or near the second end of each). The emitter bridge preferably mechanically, electrically, and thermally connects the inner and outer shells (but can alternatively perform only a subset of such functions). The emitter bridge is preferably made of the same material as the inner or outer shell (or a subset of such materials), but can additionally or alternatively include different materials from the inner and outer shells. In some examples (e.g., as shown in FIGS. 3A-3B and/or 4), the emitter bridge includes a curved member which extends from (e.g., substantially parallel with) the inner and outer shells and defines an arc that bridges between the inner and outer shells. In other examples, the emitter bridge includes a substantially flat (e.g., planar) member which extends between the inner and outer shells (e.g., substantially perpendicular to the inner and/or outer shell). However, the emitter bridge can additionally or alternatively define any other suitable structures.

The emitter module can optionally include one or more emitter leads. The emitter lead can function to conduct electrical power from the emitter module to an external load. The emitter lead is preferably electrically conductive (e.g., made of metal). In examples, the emitter lead can be (or include) a wire, cable, and/or any other suitable conductive structure. The emitter lead is preferably electrically coupled (e.g., conductively connected) to the electron emitter. The emitter lead is preferably connected (e.g., electrically and/or mechanically) to the outer shell, more preferably at or near the second end. However, the emitter lead can additionally or alternatively be connected to any other suitable elements of the emitter module (e.g., connected to any conductive element that is electrically connected to the electron emitter). However, the emitter lead can additionally or alternatively have any other suitable properties.

The electron emitter can optionally include one or more radiation shields. The radiation shields can function to reduce thermal radiation transmitted from the inner shell to the outer shell (and/or transmitted between any other suitable elements of the system). The radiation shield is preferably a refractory material and preferably has low emissivity. In examples, the radiation shield can include (e.g., be made of, consist essentially of, etc.) tungsten, tantalum, molybdenum, rhenium, nickel and/or nickel alloy(s) (e.g., as described above regarding nickel alloys), stainless steel, any other suitable superalloys, and/or any other suitable materials.

The radiation shield is preferably arranged within the chamber, more preferably arranged between the inner and outer shells. For example, the radiation shield can define one or more intermediary cylindrical shells between the inner and outer shells. The radiation shield preferably intersects a large portion of the lines of sight between the inner and outer shells (e.g., a large portion of the paths by which emissive radiation from the inner shell could otherwise reach the outer shell). For example, the radiation shield can intersect more than a threshold fraction of such paths (e.g., more than 99%, 98%, 95%, 90%, 85%, 75%, 60%, 50%, 40%, 30%, 20%, or 10%, etc.). In some embodiments, the radiation shield includes one or more spacers (e.g., electrically- and/or thermally-insulating spacers, such as spacers including alumina, MgO, BeO, and/or ZrO, etc.) arranged between the shield and other elements of the TEC (e.g., emitter module, such as the inner and/or outer shell, collector module, etc.), and/or (e.g., in embodiments that include multiple radiation shields) between radiation shields.

The radiation shield is preferably mechanically connected to the emitter module at or near the emitter bridge and/or at a location with a temperature (e.g., steady-state operation temperature) similar to the radiation shield temperature (e.g., reducing and/or minimizing conductive heat flow between the radiation shield and the emitter module), but can additionally or alternatively be connected at any other suitable location. The radiation shields can additionally or alternatively be part of (e.g., connected to) the collector module and/or any other suitable elements of the TEC.

In some embodiments, the TEC is engineered to enable an especially long emitter lead length (e.g., as compared with typical TECs, as compared with TECs defining a heating cavity, etc.), which can enable greater device efficiencies. For example, such a lead length can be achieved by extending the emitter module (e.g., a portion of the emitter module defining the wall of the heating cavity, such as the inner shell) to the opening of the heating cavity, and then extending a portion of the emitter module (e.g., a portion outside the heating cavity, such as the outer shell) away from the heating cavity opening. The outer shell preferably extends a comparable distance as the inner shell (e.g., more than 10, 25, 50, 75, 90, 100, or 110% the length of the inner shell), thereby enabling a significantly greater lead length than for a TEC for which the emitter module terminates at or near the heating cavity opening or terminates within the heating cavity.

However, the emitter module can additionally or alternatively include any other suitable elements in any suitable arrangement.

1.1.2 Collector Module.

The collector module 200 preferably functions to collect emitted electrons. The collector module preferably includes one or more electron collectors 210 (i.e., anode), collector bridges 220, and/or cooling elements 230 (e.g., as shown in FIG. 3A). The collector module can optionally include one or more collector leads 240 and/or collector contacts 250. However, the collector module can additionally or alternatively include any other suitable elements.

The electron collector is preferably a material with a low work function (e.g., in the operating environment of the TEC, such as at elevated temperature and/or in an environment with work function reduction materials such as a barium, strontium, or cesium vapor environment, optionally also including oxygen), more preferably lower than the work function of the electron emitter. In examples, the electron collector work function can be less than a threshold value, such as 0.5-2.5 eV (e.g., 0.5-0.75, 0.75-1, 1-1.2, 1.2-1.5, 1.5-2, or 2-2.5 eV, etc.). However, the electron collector can alternatively have any other suitable work function and/or other properties.

In a first embodiment, the electron collector includes (e.g., contains, is made of, consists substantially of, etc.) one or more metals, preferably refractory and/or low work function metals, such as tungsten, molybdenum, platinum, nickel, nickel alloys, superalloys, stainless steel, niobium, iridium, and/or tantalum (e.g., metals exhibiting low work function on their own, metals exhibiting low work function when exposed to a work function reduction environment, such as in a barium, strontium, and/or cesium environment, optionally including oxygen, etc.).

In a second embodiment, the electron collector includes one or more semiconductors, more preferably n-type semiconductors (e.g., as described in U.S. patent application Ser. No. 15/969,027, filed 2 May 2018 and titled "SYSTEM AND METHOD FOR WORK FUNCTION REDUCTION AND THERMIONIC ENERGY CONVERSION", which is herein incorporated in its entirety by this reference). The semiconductor is preferably a high-quality (e.g., single-crystalline, low-impurity, etc.) semiconductor, but can additionally or alternatively include semiconductor materials of any suitable quality. The semiconductor preferably includes (e.g., is, consists essentially of, etc.) Si (e.g., single-crystalline, multi-crystalline and/or micro-crystalline, amorphous, etc.), gallium arsenide (e.g., GaAs), aluminum gallium arsenide (e.g., $Al_xGa_{1-x}As$), gallium indium phosphide (e.g., $Ga_xIn_{1-x}P$), and/or aluminum gallium indium phosphide (e.g., $Al_xGa_yIn_{1-x-y}P$), but can additionally or alternatively include any suitable semiconductor materials (e.g., as described below in more detail). A person of skill in the art will recognize that the term semiconductor as used herein preferably does not include materials such as transparent conducting oxides, but can alternatively include such materials. The semiconductor is preferably highly doped (e.g., equilibrium charge carrier density greater than a threshold level such as $10^{15}/cm^3$, $10^{16}/cm^3$, $10^{17}/cm^3$, $10^{18}/cm^3$, $10^{19}/cm^3$, $10^{20}/cm^3$, etc.; equilibrium carrier density in the range $10^{15}/cm^3$-$10^{16}/cm^3$, in the range $10^{16}/cm^3$-$10^{17}/cm^3$, in the range $10^{17}/cm^3$-$10^{18}/cm^3$, in the range $10^{18}/cm^3$-$10^{20}/cm^3$, etc.), more preferably highly but not degenerately doped, but can additionally or alternatively include lower doping (e.g., equilibrium carrier density less than $10^{15}/cm^3$, less than $10^{14}/cm^3$, less than $10^{12}/cm^3$, in the range $10^{14}/cm^3$-$10^{15}/cm^3$, in the range $10^{12}/cm^3$-$10^{14}/cm^3$, etc.), which may be desirable, for example, to reduce free carrier absorption, and/or any other suitable doping level. In a specific example, the bulk semiconductor in has an equilibrium carrier density in the range $10^{16}/cm^3$-$3\times10^{17}/cm^3$ (e.g., $1\text{-}3\times10^{16}/cm^3$, $3\text{-}6\times10^{16}/cm^3$, $6\text{-}10\times10^{16}/cm^3$, $1\text{-}3\times10^{17}/cm^3$, $7.5\times10^{16}/cm^3$-$2\times10^{17}/cm^3$, etc.). The semiconductor preferably has substantially uniform doping, but can additionally or alternatively include doping changes (e.g., changing laterally and/or with depth) such as gradients, discontinuities, and/or any other suitable doping features. The semiconductor is preferably n-type silicon, but can additionally or alternatively include n-type silicon carbide, n-type germanium, an n-type III-V semiconductor, and/or any other suitable materials. In some examples of this embodiment, the electron collector includes one or more additional layers (e.g., on or near the semiconductor), such as described in U.S. patent application Ser. No. 15/969,027, filed 2 May 2018 and titled "SYSTEM AND METHOD FOR WORK FUNCTION REDUCTION AND THERMIONIC ENERGY CONVERSION", which is herein incorporated in its entirety by this reference.

The electron collector preferably has an alkali metal and/or alkaline earth metal coating (and/or an oxide thereof), which can function to reduce the collector work function. However, the electron collector can additionally or alternatively include any other suitable materials.

The electron collector is preferably conductively connected to other elements of the collector module, such as the collector bridge and/or the collector lead (e.g., wherein the electron collector is conductively connected to the collector lead via the collector bridge and/or the collector contact). The electron collector is preferably thermally coupled to the cooling element (e.g., wherein heat is transferred from the electron collector to the cooling element, thereby cooling the electron collector), such as being directly connected to the cooling element, thermally coupled to the cooling element via the collector contact and/or other elements of the collector module, and/or otherwise thermally coupled to the cooling element. The electron collector is preferably mechanically coupled (e.g., mechanically connected) to the collector bridge, collector contact, and/or cooling element, but can additionally or alternatively be connected to any other suitable elements of the collector module. In some examples, the electron collector is arranged between the cooling element and the electron emitter, and/or is arranged between the cooling element and the chamber (e.g., the entire chamber; a portion of the chamber between the electron collector and the electron emitter, such as a portion of the chamber opposing the collector contact across the electron collector; etc.). However, the cooling element can additionally or alternatively have any other suitable arrangement.

The electron collector preferably opposes the electron emitter across the chamber (e.g., wherein a collector surface of the electron collector substantially faces the electron emitter across the chamber). The collector surface is preferably a substantially planar surface (e.g., defining a collector plane). The collector plane is preferably substantially parallel the emitter plane, but can alternatively have any other suitable orientation. The space across the chamber between the electron emitter and electron collector (e.g., interelectrode spacing) preferably defines a small gap. The gap is preferably 0.1-10 μm, more preferably 0.5-3 μm (e.g., 0.75 μm, 1 μm, 2 μm, etc.), but can alternatively be 50-100 nm, less than 50 nm, 10-25 μm, 25-50 μm, greater than 50 μm, or any other suitable height. The gap can be established at all times, or can be established while the TEC is under standard operating conditions (e.g., wherein the chamber pressure is substantially lower than an ambient environment pressure, such as atmospheric pressure, wherein the power input is delivering power to the TEC, wherein TEC temperatures are in a substantially steady state condition, etc.).

Figure 3C:
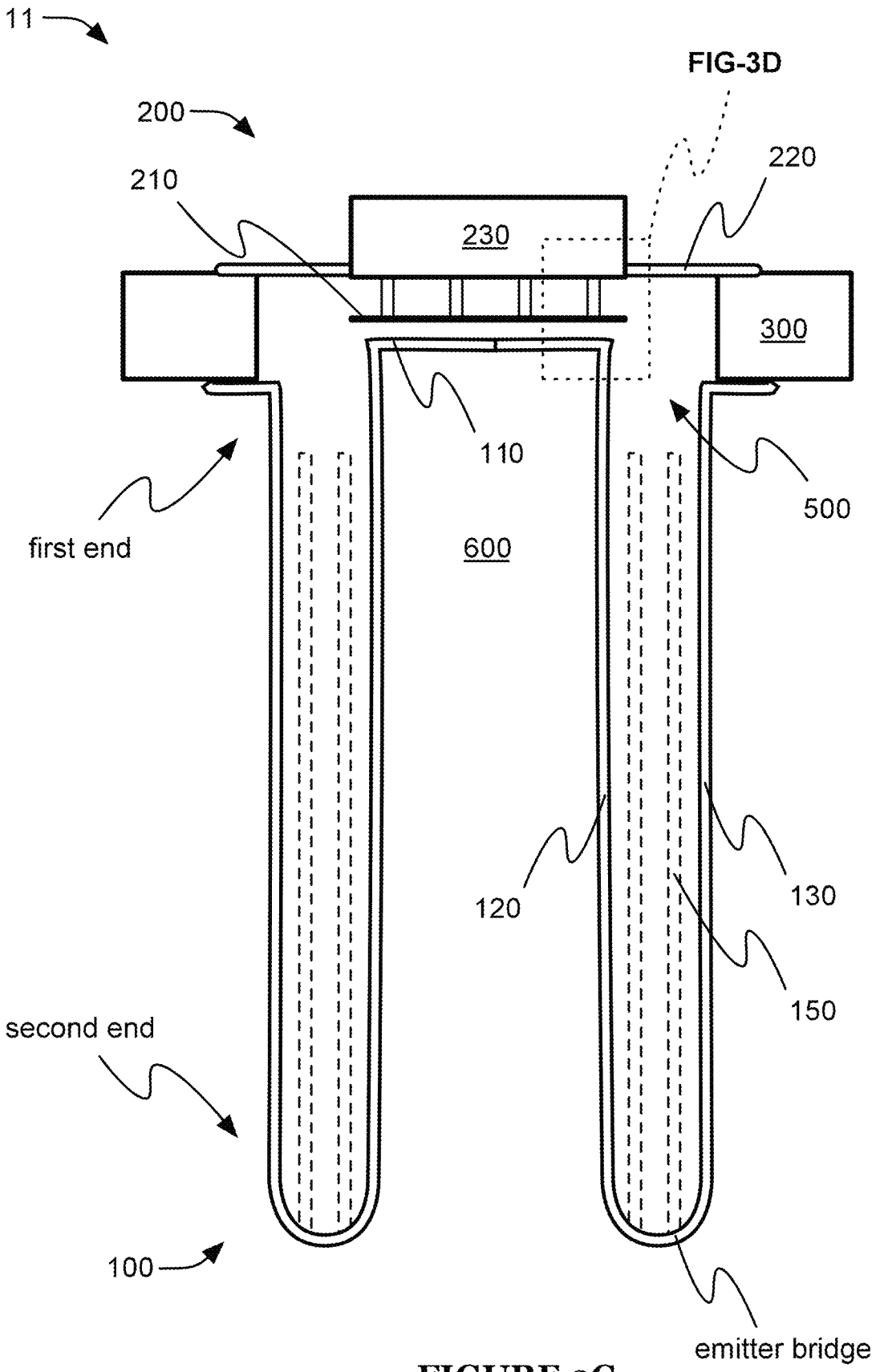
FIG. 3C is a schematic representation of a cross-sectional view of a second example of a TEC of the system.
Figure 3D:
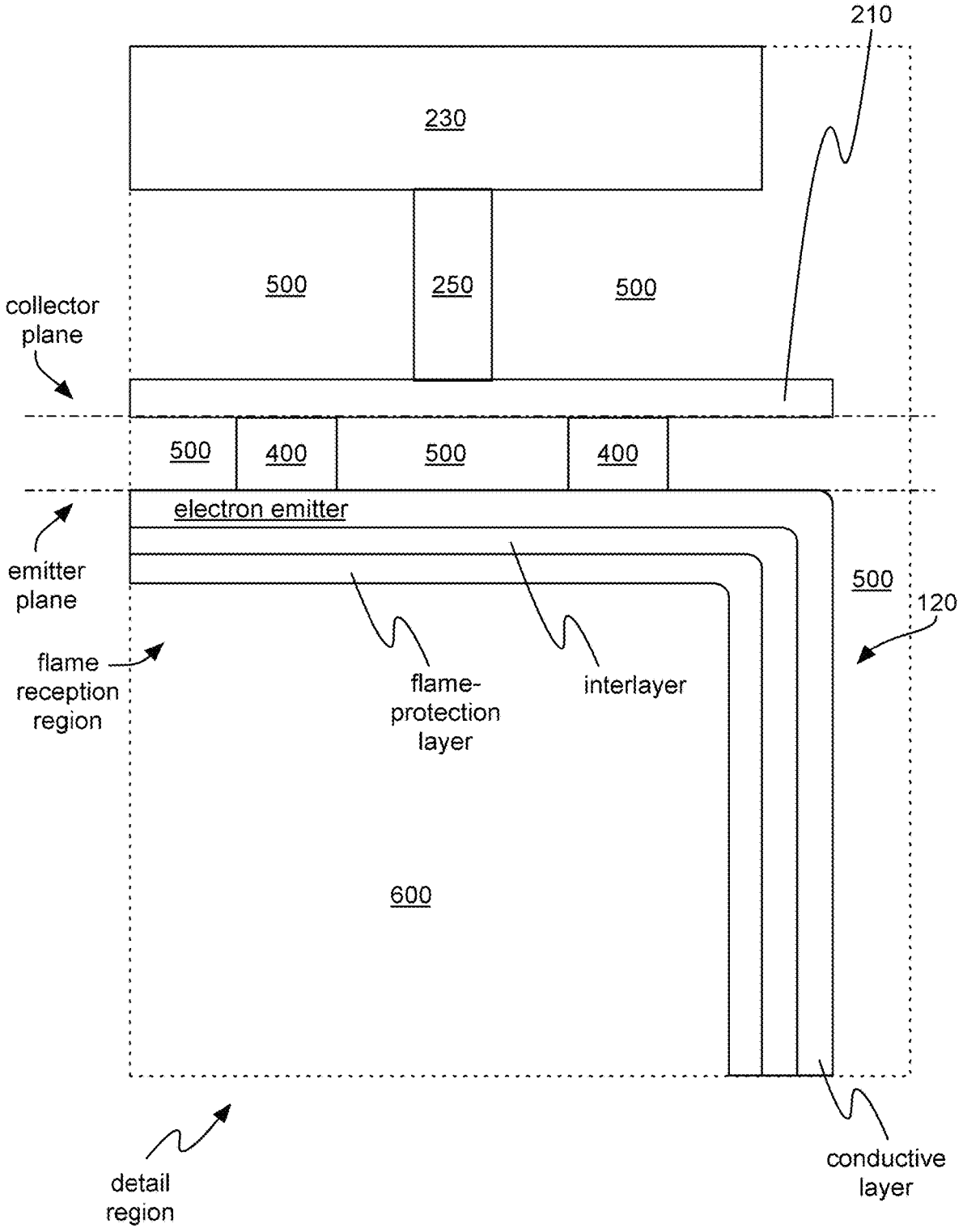
FIG. 3D is a detail view of a specific example of a portion of the TEC of FIG. 3C.
Figure 4:
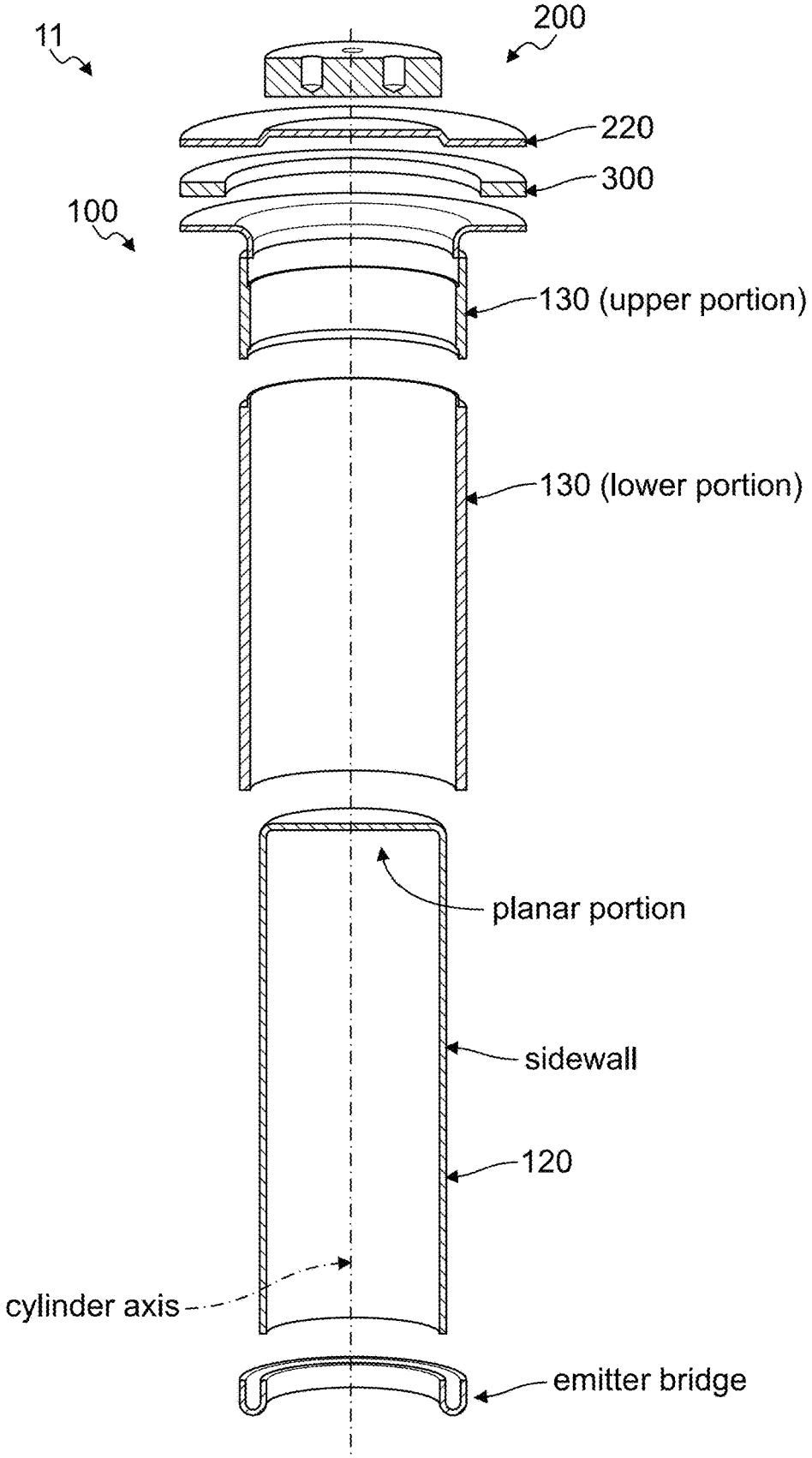
FIG. 4 is an exploded cross-sectional view of a first specific example of the TEC.
Figure 5A:
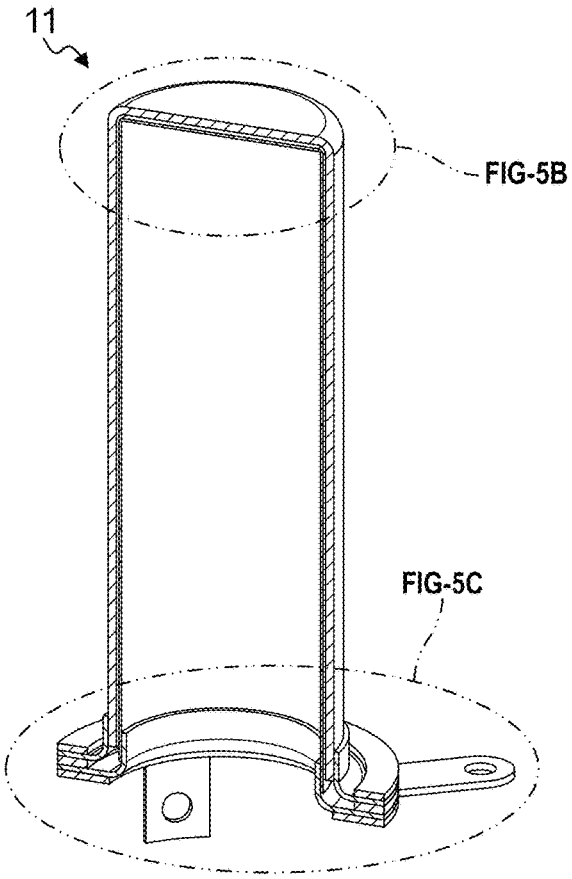
FIG. 5A is a cross-sectional view of a second specific example of the TEC.
Figure 5B:
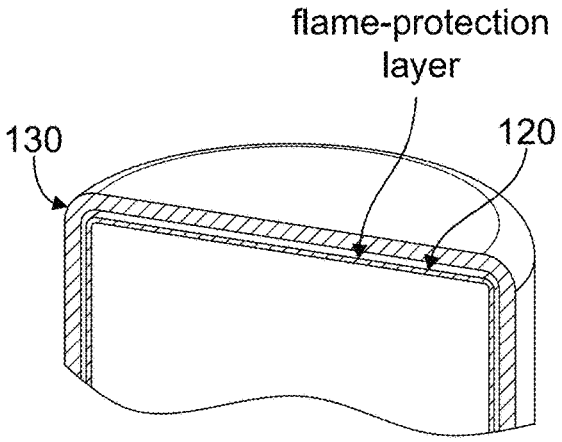
FIG. 5B is a detail view of a first region of the cross-sectional view of FIG. 5A.
Figure 5C:
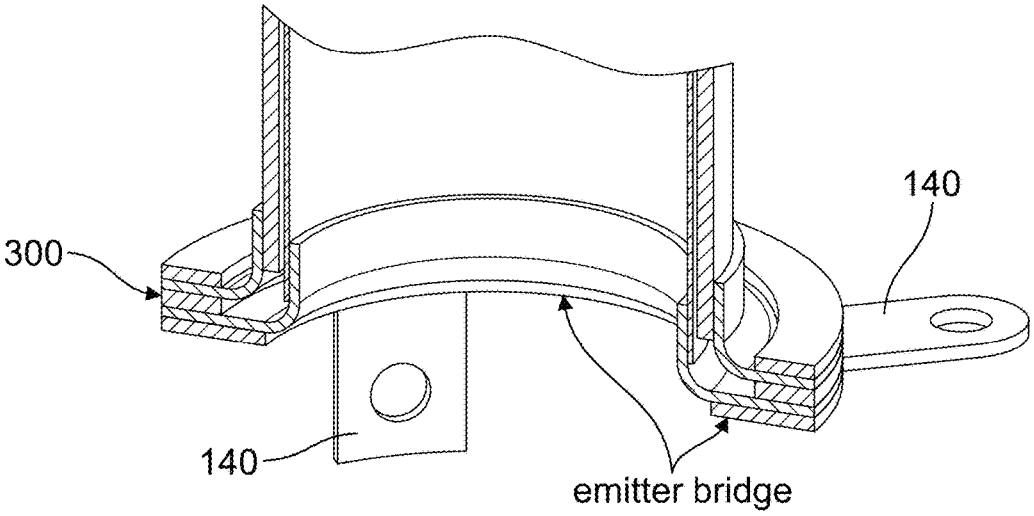
FIG. 5C is a detail view of a second region of the cross-sectional view of FIG. 5A.

In some embodiments, the electron collector (e.g., the collector surface) bounds the chamber (e.g., as shown in FIGS. 3A-3B). Additionally or alternatively, the electron collector can be contained within the chamber (e.g., entirely or substantially entirely within the chamber), such as wherein the electron collector is contacted (e.g., during system operation, at all times, etc.) by one or more collector contacts 250 (e.g., as shown in FIGS. 3C-3D). The collector contact(s) preferably contact the electron collector in one or more regions opposing the collector surface across the electron collector (e.g., at a back surface opposing the collector surface), but can additionally or alternatively contact the electron collector in any other suitable locations. The collector contacts preferably electrically, thermally, and/or mechanically couple the electron collector to other elements of the collector module (e.g., to the cooling element). Accordingly, the collector contacts preferably include one or more electrically- and/or thermally-conductive materials. The collector contacts can optionally retain the electron collector near other elements of the collector module (e.g., the cooling element), such as being adhered and/or bonded to the electron collector. The collector contacts can additionally or alternatively retain the electron collector near the electron emitter (e.g., maintaining the interelectrode gap), preferably retaining the electron collector against the spacers. For example, the collector contacts can include one or more compliant (e.g., deformable) structures compressed between the electron collector and one or more other elements of the collector module (e.g., cooling element), thereby exerting a force on the electron collector away from the other element(s) and toward the electron emitter. However, the electron collector can additionally or alternatively be coupled to the other elements of the collector module (and/or other elements of the system) in any other suitable manner.

However, the electron collector can additionally or alternatively include any other suitable elements and/or can have any other suitable arrangement.

The collector bridge preferably functions to couple the electron collector to one or more other elements of the TEC. The collector bridge preferably couples the electron collector mechanically (e.g., to the seal) and/or electrically (e.g., to the collector lead), and can optionally thermally couple the electron collector to other elements of the TEC. The collector bridge preferably includes (e.g., is made of, consists essentially of, etc.) one or more metals, such as the same metal as the outer shell and/or different metals. The collector bridge preferably exhibits a similar coefficient of thermal expansion as the seal, which can facilitate maintenance of the bond between the collector bridge and seal. However, the collector bridge can additionally or alternatively include any other suitable materials.

The collector bridge preferably includes a planar portion, more preferably a planar portion substantially parallel the collector plane. The planar portion preferably extends outward from the electron collector (e.g., to or toward the seal). In one example, the planar portion defines a region (e.g., circular region) extending out to and/or past the outer shell of the emitter module. The collector bridge can additionally or alternatively include one or more non-planar portions (e.g., extending substantially normal to the collector plane) and/or portions with any other suitable shape and/or orientation.

In some embodiments, some or all of the collector bridge is substantially deformable (e.g., along a direction normal to the collector plane), which can function to enable movement of the electron collector with respect to the electron emitter (e.g., movement toward and/or away from the electron emitter), such as to establish and/or maintain a desired interelectrode spacing. The collector bridge can deform in response to thermal deformation of elements of the TEC, due to a pressure differential between the chamber and the ambient environment, and/or due to any other suitable forces and/or strains. In some examples, the deformable elements can include a thin foil, a corrugated or bellows structure, and/or any other suitable deformable elements. Such deformable structures can additionally or alternatively be included elsewhere in the collector module, in the emitter module (e.g., opposing the collector bridge across the seal, along the inner and/or outer shell, within the emitter bridge, etc.), and/or in any other suitable locations of the TEC.

However, the collector bridge can additionally or alternatively include any other suitable elements in any suitable arrangement.

The cooling element preferably functions to facilitate heat removal from the electron collector (and/or any other suitable elements of the TEC, such as other elements of the collector module). The heat removal is preferably convective heat removal (e.g., in cooperation with the airflow module), but can additionally or alternatively include radiative heat removal, conductive heat removal, and/or heat removal by any other suitable mechanism. The cooling element (e.g., in cooperation with the airflow module) preferably maintains the electron collector at or below a target temperature (e.g., target temperature in the range 0-100, 100-200, 200-400, 400-600, 200-275, 250-350, 325-400, or 275-325° C., such as 300° C.) during TEC operation. The cooling element is preferably thermally coupled to the electron collector (e.g., coupled by thermally conductive material, such as metal). In some examples, the cooling element includes one or more surface modifiers, preferably including (e.g., made of) metal, which can function to induce turbulence (e.g., in a heat transfer fluid, such as air within the airflow module) and/or otherwise increase fluid interaction (e.g., heat transfer) with the cooling element. Such surface modifiers can include fins, baffles, ribs, dimples, and/or any other suitable structures. For example, the cooling element can include a plurality of fins (e.g., parallel plates) extending into (and preferably substantially parallel to) an airflow path defined by the airflow module (e.g., as shown in FIGS. 2A and/or 2B).

The cooling element is preferably arranged proximal the electron collector and/or otherwise configured to prioritize cooling of the electron collector (e.g., more than other elements of the collector module, more than other elements of the TEC, etc.). Such an arrangement can provide benefits over alternative arrangements, such as wherein the cooling element is arranged proximal and/or prioritizes cooling of other elements of the TEC. Such other elements can include the seal, elements arranged at and/or near the heating cavity opening (e.g., the emitter bridge), and/or any other suitable elements. For example, this arrangement can enable maintenance of the electron collector at a lower temperature than in other arrangements, such as a temperature below 450, 400, 350, 300, 250, 200, 150, 100, 50° C. (or any other suitable temperature), resulting in a greater possible device efficiency.

However, the cooling element can additionally or alternatively include any other suitable elements with any suitable arrangement.

The collector module can optionally include a collector lead. The collector lead can function to conduct electrical power from the collector module to the external load (e.g., wherein the TEC electrically drives the external electrical load via the emitter lead and collector lead). The collector lead is preferably electrically conductive. For example, the collector lead can include (e.g., be) one or more wires, cables, other metal structures, and/or any other suitable elements. The collector lead is preferably electrically coupled (more preferably conductively connected) to the electron collector. The collector lead is preferably connected (e.g., electrically and/or mechanically) to the collector bridge, more preferably at or near an outward portion of the collector bridge (e.g., where the collector bridge meets the seal). However, the collector lead can additionally or alternatively be connected to any other suitable element of the collector module (e.g., any conductive element electrically connected to the electron collector).

In some embodiments, the collector module includes one or more elements such as described in U.S. patent application Ser. No. 15/969,027, filed 2 May 2018 and titled "SYSTEM AND METHOD FOR WORK FUNCTION REDUCTION AND THERMIONIC ENERGY CONVERSION", which is herein incorporated in its entirety by this reference, such as regarding the anode of U.S. patent application Ser. No. 15/969,027 (e.g., wherein the electron collector is and/or includes elements of the anode of U.S. patent application Ser. No. 15/969,027).

However, the collector module can additionally or alternatively include any other suitable elements in any suitable arrangement.

1.1.3 Seal.

The seal 300 preferably functions to mechanically couple (e.g., connect) the emitter module and collector module, more preferably while electrically isolating the emitter module from the collector module. Preferably the emitter and collector modules are substantially only electrically coupled to each other via the emitter and collector leads through an external load and/or via electrons emitted across the chamber.

The seal preferably includes one or more electrical insulator materials, more preferably materials that can withstand (e.g., without melting, deforming, and/or decomposing) the seal temperature during TEC operation. The materials are preferably glass and/or ceramic (e.g., bulk ceramic, deposited ceramic, etc.; crystalline and/or amorphous ceramics). For example, the seal can include one or more boride, carbide, oxide, and/or nitride materials and/or any other suitable materials. In specific examples, the seal includes one or more of alumina (e.g., sapphire, amorphous alumina, etc.), aluminum nitride, silica, silicate glass, silicon, silicon carbide, silicon nitride, and/or any other suitable materials.

Figure 2B:
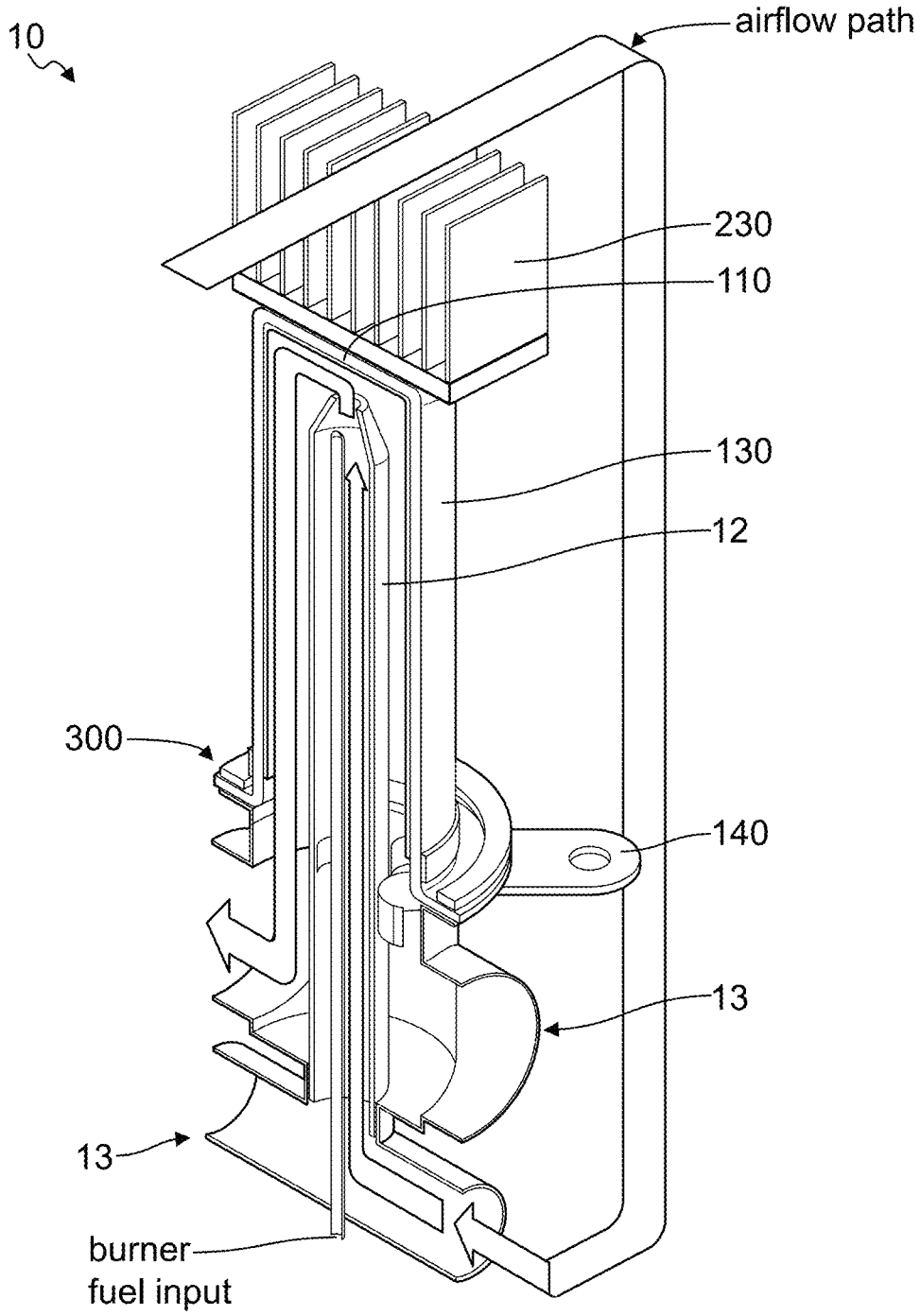
Figure 2C:
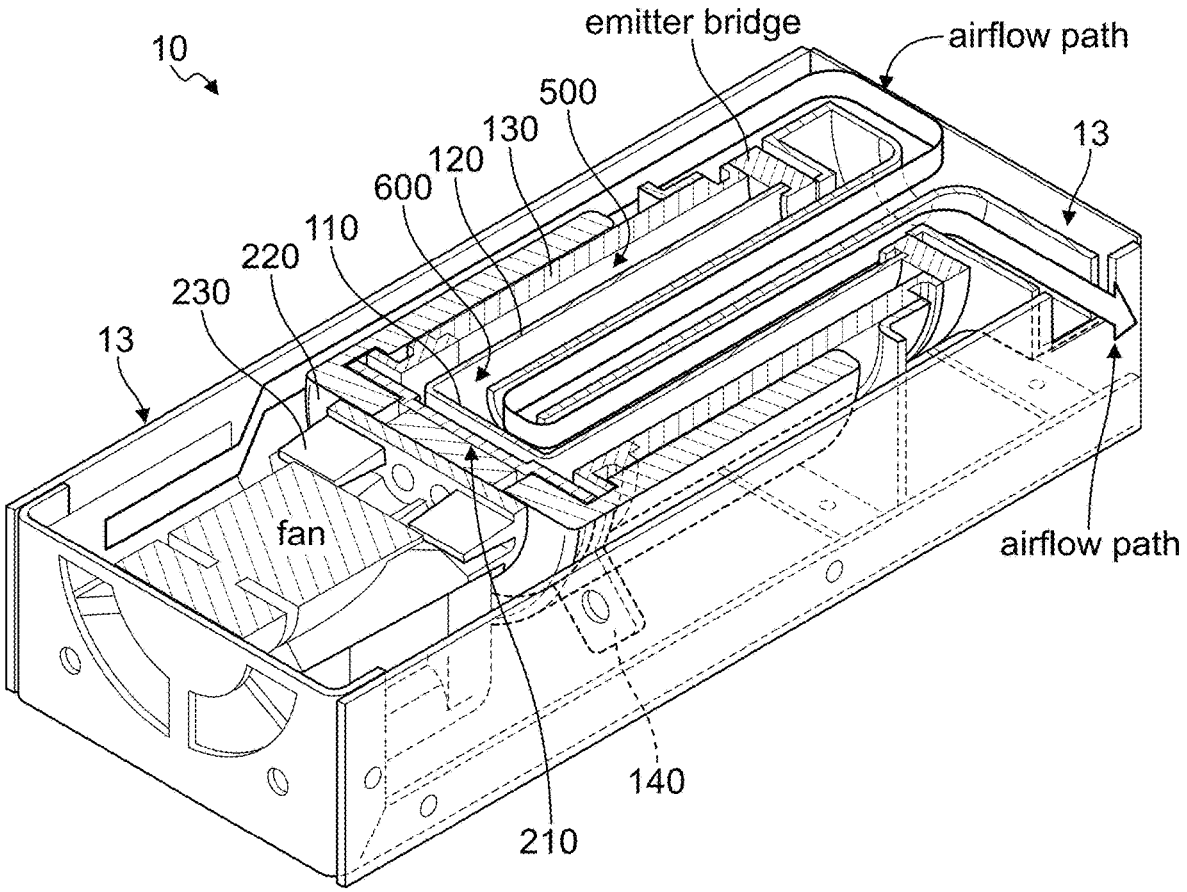

The seal is preferably arranged between the collector bridge and the emitter module outer shell, more preferably at or near the first end of the outer shell. The seal preferably mechanically connects the collector bridge to the outer shell (e.g., as shown in FIGS. 2A, 3A, and/or 4). In alternate embodiments (e.g., in which the outer shell is an element of the collector module, such as being electrically connected to the electron collector rather than to the electron emitter), the seal can be arranged between the outer shell and the inner shell, preferably mechanically connecting (and preferably not electrically connecting) the outer shell to the inner shell (e.g., in examples in which the emitter bridge is a portion of the inner shell, connecting the outer shell to the emitter bridge), such as shown by way of examples in FIGS. 2B and/or 5. However, the seal can additionally or alternatively be arranged at any other suitable location of the TEC, preferably mechanically connecting (and preferably not electrically connecting) the emitter module to the collector module at or near their respective bounds (e.g., portion of the emitter module farthest, along a direct conductive path, from the electron emitter; portion of the collector module farthest, along a direct conductive path, from the electron collector). A person of skill in the art will recognize that the TEC may be tolerant (e.g., compared to other electrical devices) of some parasitic electrical shorts (e.g., between the emitter and collector modules, such as via the seal). For example, in a TEC with an output voltage of approximately 1 V, a 10Ω parasitic short between the emitter and collector modules will result in a loss in current output of approximately 0.1 A, which may be acceptable. Accordingly, a person of skill in the art will recognize that, in some examples, elements of the TEC (e.g., the seal) that are not intended to electrically connect other elements (e.g., the emitter and collector modules) may nonetheless provide parasitic conductive paths (e.g., with resistances greater than 100Ω, 10Ω, and/or 1Ω, etc.).

The seal can be bonded (e.g., brazed) to one or both of the elements that it connects. Alternatively, the seal can be deposited onto one of the elements that it connects and/or can be otherwise affixed.

In some embodiments, the seal is substantially flat, and preferably defines a footprint that substantially matches (e.g., overlaps) one or more of the surfaces to which it is affixed (e.g., the outer shell surface and outer perimeter of the collector bridge surface, etc.). In other embodiments, the seal defines a shape complimentary to the outer shell (e.g., cylindrical shell in embodiments in which the outer shell is a cylindrical shell, hexagonal prism shell in embodiments in which the outer shell is a hexagonal prism shell, etc.), such as wherein the collector bridge is affixed to an inner surface of the seal and the outer shell is affixed to an outer surface of the seal (e.g., opposing the inner surface across a wall of the seal, preferably the wall defining the shell). In one example, the seal is less than 10 mm thick (e.g., 0.2, 0.5, 1, 2, 3, 5, 0.05-0.2, 0.2-1, 1-3, or 3-10 mm) and has a width in the range 10-100 mm, preferably 20-50 mm (e.g., defining a circular shape with a diameter in the range 20-50 mm).

However the seal can additionally or alternatively include any other suitable elements with any suitable arrangement.

1.1.4 Spacer.

The TEC can optionally include a spacer 400. The spacer can function to maintain a separation distance (e.g., minimum separation distance) between the electron emitter and electron collector. In one example, the spacer includes one or more elements such as described in U.S. patent application Ser. No. 16/044,215, filed 24 Jul. 2018 and titled "SMALL GAP DEVICE SYSTEM AND METHOD OF FABRICATION", which is herein incorporated in its entirety by this reference.

The spacer is preferably arranged in the chamber between the electron emitter and electron collector. The spacer can be affixed to one or both of the electron emitter and electron collector, can be held in place by a compressive force (e.g., arising from thermal expansion of elements of the TEC, from differential pressures between the chamber and ambient environment, etc.), and/or held in place in any other suitable manner. The spacer preferably does not form a full continuous layer (e.g., does not obstruct the entire line of sight between the electron emitter and electron collector). For example, the spacer can be a porous layer, a collection of dispersed objects (e.g., microspheres, rods, mesas, etc.), and/or can have any other suitable structure. However, the spacer can alternatively be a continuous layer.

The spacer thickness (defined along a direction from the electron emitter to electron collector, such as normal to the emitter plane and/or collector plane) preferably establishes a substantially uniform spacing between the electron emitter and electron collector (e.g., having a substantially uniform thickness at the points at which the spacer contacts the electron emitter and electron collector). In one example, in which the spacer includes a collection of dispersed microspheres, the spacer thickness is defined as equal to the diameter of the microspheres (e.g., of the largest microspheres of the collection). The spacer preferably spans substantially the entire area of electron emitter-electron collector overlap, but can additionally or alternatively span a subset thereof, span area outside the overlap, and/or have any other suitable shape or extent.

The spacer preferably includes (e.g., contains, is made of, consists essentially of, etc.) one or more electrical insulators, such that the spacer does not electrically connect the emitter and collector modules. The material is preferably capable of withstanding high temperatures (e.g., the electron emitter temperature during TEC operation) without melting, deforming, and/or decomposing. The material can optionally exhibit low thermal conductivity, which can reduce heat conduction from the electron emitter to the electron collector.

The spacers 400 preferably include (e.g., are made of) one or more thermally and/or electrically insulating materials. The materials can include oxide compounds (e.g., metal and/or semiconductor oxides) and/or any other suitable compounds, such as metal and/or semiconductor nitrides, oxynitrides, fluorides, and/or borides. For example, the materials can include oxides of Al, Be, Hf, La, Mg, Th, Zr, W, and/or Si, and/or variants thereof (e.g., yttria-stabilized zirconia). The spacer materials are preferably substantially amorphous, but can additionally or alternatively have any suitable crystallinity (e.g., semi-crystalline, nano- and/or micro-crystalline, single-crystalline, etc.). However, the spacers 400 can additionally or alternatively include any other suitable materials (e.g., as described above regarding materials).

The spacers can include a combination of two or more materials (e.g., enabling material property tuning, protection of less robust materials, etc.), but can alternatively include a single material. The material combinations can include alloys, mixtures (e.g. isotropic mixtures, anisotropic mixtures, etc.), multilayer stacks, and/or any other suitable combinations. For example, multilayer stacks can reduce thermal and/or electrical conductions (e.g., due to carrier boundary scattering), and/or can increase spacer robustness (e.g., at high temperature, in chemically-reactive environments, etc.), such as by partially or entirely encapsulating less robust materials within more robust material layers. In a first specific example, the spacers 400 are made of a hafnia aluminate alloy. In a second specific example, the spacers 400 include a multilayer (e.g., three-layer) structure, with an intermediary layer (e.g., including alumina or an alumina-containing compound, such as a hafnia-alumina alloy; including hafnia or a hafnia-containing compound, such as a hafnia-alumina alloy; preferably consisting essentially of this material) in between (e.g., substantially encapsulated between) two outer layers (e.g., including hafnia or a hafnia-containing compound, such as a different hafnia-alumina alloy than the intermediate layer; including alumina or an alumina-containing compound, such as a different hafnia-alumina alloy than the intermediate layer; preferably consisting essentially of this material), the two outer layers having the same or different materials as each other, which can function, for example, to reduce evaporation and/or crystallization of species in the intermediary layer (e.g., Al, Hf, etc.) at high temperatures. In this second specific example, the first outer layer preferably contacts the first electrode inner surface, and the second outer layer preferably contacts the second electrode inner surface.

Material combinations and/or surface functionalizations (e.g., including terminations such as hydrogen, hydroxyl, hydrocarbon, nitrogen, thiol, silane, etc.) can additionally or alternatively be employed to alter (e.g., enhance, reduce) surface adhesion (e.g., to an electrode inner surface), thermal and/or electrical contact, diffusion (e.g., interdiffusion), chemical reactions, and/or any other suitable interfacial properties and/or processes. For example, the spacer can include a first layer arranged in contact with a first electrode (e.g., electron emitter or electron collector) and a second layer arranged in contact with a second electrode (e.g., opposing the first electrode). In a first example, the first layer exhibits strong adhesion to the first electrode (e.g., the first layer—first electrode interface has low interfacial energy), and the second layer exhibits weak adhesion to the second electrode (e.g., the second layer—second electrode interface has high interfacial energy). In a second example, both the first and second layers exhibit weak adhesion to the respective electrode that they contact (e.g., have high interfacial energy, substantially equal interfacial energy). In a third example, both the first and second layers exhibit strong adhesion to the respective electrode that they contact (e.g., have low interfacial energy, substantially equal interfacial energy). In a specific example, a spacer surface contacting the cathode includes a H-terminated surface functionalization, and a spacer surface contacting the anode includes a OH-terminated surface functionalization. However, the spacers can include any other suitable combination of materials, and the spacers can additionally or alternatively include any other suitable elements in any suitable arrangement.

1.2 Power Input.

The system can optionally include one or more power inputs 12. The power input can function to heat the electron emitter and/or other elements of the emitter module, thereby providing input energy to the TEC. The power input is preferably a burner, more preferably a recuperating burner. However, the power input can alternatively include any other suitable chemical and energy input, radiothermal input, and/or any other heat input and/or other element operable to heat the electron emitter.

The power input (e.g., burner) preferably delivers heat (e.g., heat of combustion) to the TEC (e.g., to the emitter module, preferably at and/or near the heat-reception region). The heat can be delivered radiatively, convectively, conductively, and/or in any other suitable manner. For example, the power input can produce a flame near and/or incident upon the flame-reception region of the emitter module.

The power input is preferably arranged within the heating cavity. Exhaust gas produced by the burner preferably transfers heat (e.g., from itself) to other elements of the system while exiting the heating cavity. For example, the exhaust gas can transfer heat to one or more gasses, such as input gasses used by the burner (e.g., air or oxygen, fuel, etc.) and/or output gasses such as burner exhaust gasses, to the emitter module (e.g., emitter module inner shell and/or emitter bridge), and/or to any other suitable elements. The power input can additionally or alternatively enable heat transfer (e.g., radiative heat transfer) between the burner and the emitter module (e.g., the inner shell).

However, the power input can additionally or alternatively include any other suitable elements in any suitable arrangement.

1.3 Airflow Module.

The system can optionally include one or more airflow modules 13. The airflow module can include one or more fans and/or ducts. The fan (and/or any other suitable element capable of causing fluid flow, such as blowers, compressors, etc.) preferably causes airflow (and/or flow of any other suitable fluid) at and/or near the TEC cooling element. The flowing air (or other fluid) preferably removes heat from the cooling element (and/or from any other suitable elements of the system, such as other elements of the collector module). In some examples, the fan forces air through one or more ducts (e.g., along an airflow path defined by the duct).

The duct can function to define one or more airflow paths. The duct preferably directs airflow from the cooling element to the heating cavity (e.g., wherein airflow enters the heating cavity at and/or near the emitter bridge). The air (and/or other fluid) can remove heat from the TEC, thereby heating the air. The heat is preferably removed from the cooling element, but can additionally or alternatively be removed from the outer shell, the inner shell, and/or any other suitable elements of the TEC. The air can additionally or alternatively remove heat from the burner, from the exhaust gas, and/or from any other suitable heat sources. This preheated air preferably feeds the burner (e.g., increasing burner efficiency), but can additionally or alternatively be used in any other suitable manner (or can go unused).

However, the airflow module can additionally or alternatively include any other suitable elements in any suitable arrangement.

1.4 Operation Temperature.

In some embodiments, during operation (e.g., while performing the method 20 described below), one or more elements of the TEC preferably remain within temperature ranges such as described below. For example, the temperature ranges can arise under substantially steady-state operating conditions in which the power input within the heating cavity is in the range 0-5000 W (e.g., 150-300, 150-200, 200-250, 250-300, 300-500, 500-1000, 1000-2000, or 2000-5000 W, etc.) and/or in which the electrical power output generated by the TEC is in the range 0-2500 W (e.g., 0-10, 10-20, 20-40, 40-60, 60-100, 100-200, 200-500, 500-1000, or 1000-2500 W, etc.).

In these embodiments, the electron emitter preferably has a temperature greater than 500° C. (e.g., a temperature within the range 500-800, 800-1000, 1000-1600, 1100-1400, 1000-1200, 1200-1300, 1300-1400, 1400-1600, or 1600-2000° C., etc., or a temperature greater than 2000° C.), more preferably greater than 1000° C. The inner shell temperature preferably decreases (e.g., monotonically, such as strict monotonically) along one or more paths (e.g., conductive paths defined by the inner shell) from the electron emitter to the emitter bridge (which is preferably lower in temperature than the electron emitter). The emitter bridge preferably has a temperature significantly lower than the electron emitter, such as lower by at least a threshold temperature difference (e.g., 100, 200, 250, 300, 350, 400, 450, 500, 550, 600, 650, 700, 750, 800, 900, 1000, 1200, 100-300, 250-750, 400-600, 600-800, 800-1200, or more than 1200° C., etc.), and/or preferably has a temperature greater than 100° C. (e.g., 300-1200, 100-400, 300-500, 500-1000, 1000-1200, 600-700, 700-800, and/or 800-1000° C., etc.), more preferably a temperature in the range 300-900° C. (e.g., 300-600, 600-800, or 750-900° C. The outer shell temperature preferably decreases (e.g., monotonically, such as strict monotonically) along one or more paths (e.g., conductive paths defined by the outer shell) from the emitter bridge to the seal and/or to the emitter lead (each of which are preferably lower in temperature than the electron emitter). The temperature difference between the seal and emitter bridge is preferably less than (but can alternatively be greater than or substantially equal to) the temperature difference between the emitter bridge and the electron emitter. The difference between these temperature differences is preferably greater than 50° C. (e.g., 50-100, 100-150, 150-300, or greater than 300° C.), more preferably greater than 100° C. The seal is preferably at a temperature of less than 600° C. (e.g., 300-450, 450-600, or less than 300° C.), more preferably less than 450° C. Accordingly, the emitter module temperature preferably decreases (e.g., monotonically, such as strict monotonically) along one or more paths (e.g., conductive paths defined by the emitter) from the electron emitter to the seal and/or to the emitter lead.

In these embodiments, the electron collector preferably has a temperature less than 700° C. (e.g., 100-600, 150-350, 200-300, 500-700, or less than 100° C., etc.), more preferably less than 400° C. The electron collector is preferably at a lower temperature as the seal, but can alternatively be at a higher temperature or have substantially the same temperature. For example, the temperature difference between the electron collector and the seal can be greater than 50° C. (e.g., 50-100, 100-150, 150-300, or greater than 300° C., etc.), more preferably greater than 100° C.

Figure 6A:
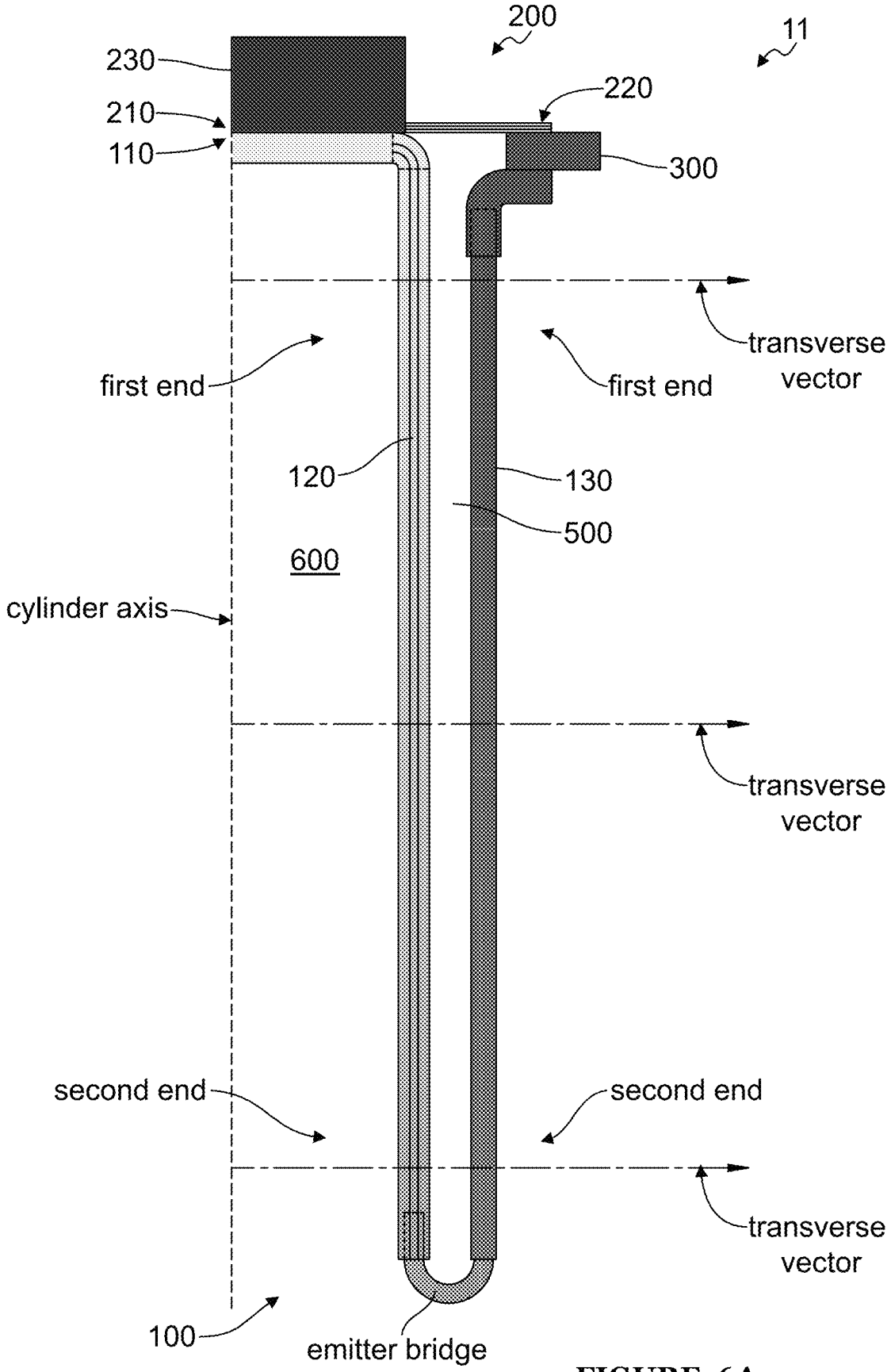
FIG. 6A is a radial cross-section view of an axisymmetric example of the TEC.
Figure 6B:
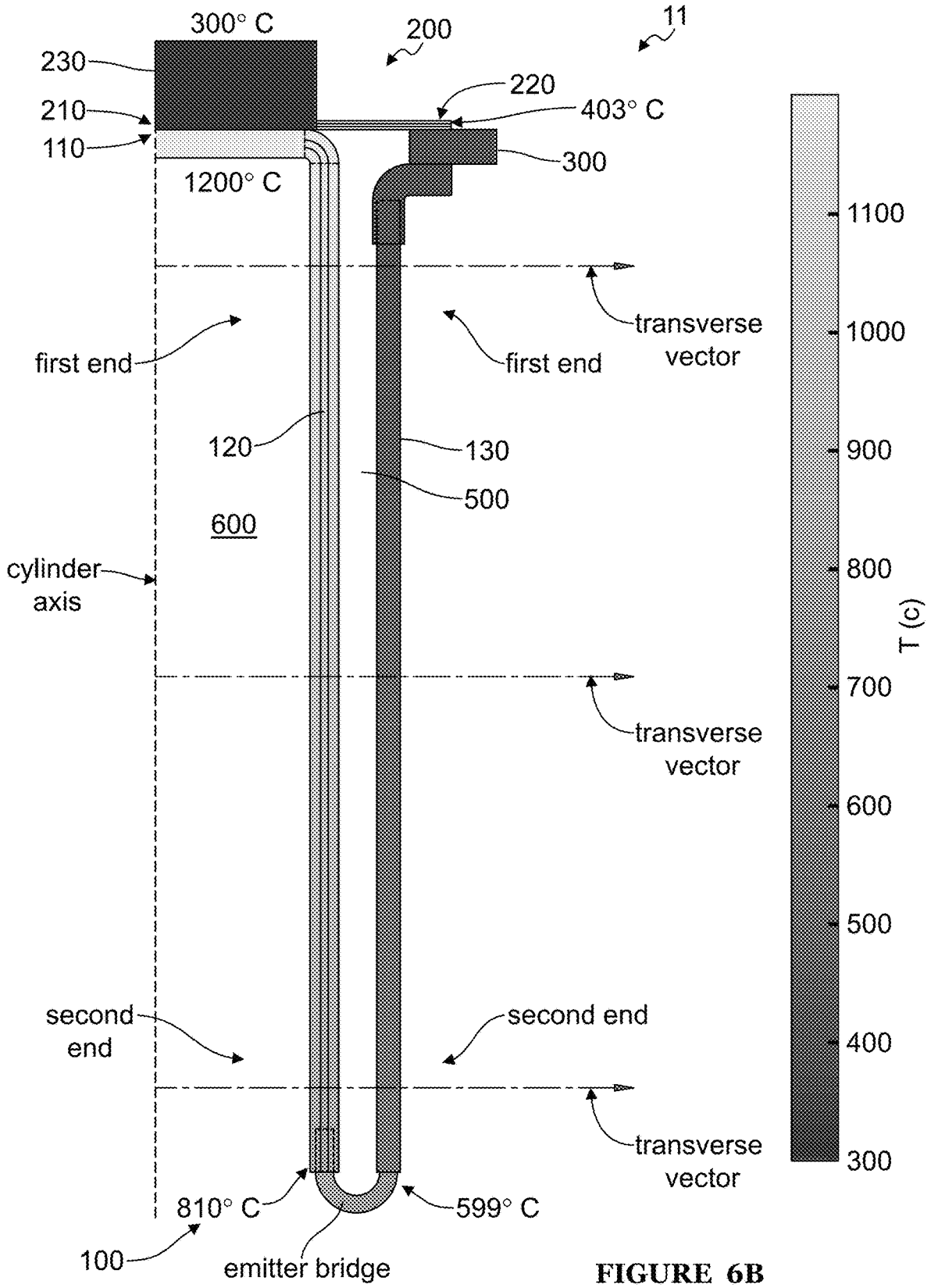
FIG. 6B is a radial cross-section view of a specific example of the TEC of FIG. 6A.

In some examples (e.g., in which the power input is 180-200 W and/or the electrical power output is 20-30 W, in which the electron emitter is maintained at approximately 1200° C. and/or the cooling element is maintained at approximately 300° C., etc.), the operation temperatures of one or more elements of the TEC are equal to or within a threshold range (e.g., within 150, 100, 75, 50, 30, or 15° C., etc.) of the temperatures shown in FIG. 6B. Although FIG. 6B depicts a specific axisymmetric example of the TEC (symmetric about the cylinder axis), other examples of the TEC may also exhibit similar temperatures (e.g., within the threshold range) and/or temperature differences (e.g., wherein the temperatures of the elements are different from those shown in FIG. 6B, but the absolute and/or proportional differences between temperatures of the elements are within a threshold range of the temperature differences depicted in FIG. 6B; wherein the absolute difference threshold range can be within 150, 100, 75, 50, 30, or 15° C., etc.; and/or wherein the proportional difference threshold range can be within 1, 2, 5, 10, 15, 20, 25, or 50%, etc., of the absolute temperature of one of the elements), and/or may exhibit any other suitable temperature characteristics.

The thermal resistance of the emitter module, from the electron emitter to the seal, is preferably greater than a threshold value (e.g., 5, 10, 15, 20, 25, 30, 40, 50, 3-10, 10-20, 20-30, or 30-50 K/W, etc.). The thermal resistance of the inner shell (from the electron emitter to the emitter bridge) is preferably greater than the thermal resistance of the outer shell (from the emitter bridge to the seal), such as defining a thermal resistance ratio greater than a threshold amount (e.g., at least 1.1, 1.2, 1.3, 1.5, 2, 2.5, or 3 times greater, etc.).

However, the elements of the TEC can additionally or alternatively have any other suitable temperatures (e.g., during operation), and/or the TEC may additionally or alternatively exhibit any other suitable thermal properties.

1.5 Materials.

The elements of the system can include (e.g., be made of) any suitable materials and/or combinations of materials. The materials can include semiconductors, metals, insulators, 2D materials (e.g., 2D topological materials, single layer materials, etc.), organic compounds (e.g., polymers, small organic molecules, etc.), and/or any other suitable material types.

The semiconductors can include group IV semiconductors, such as Si, Ge, SiC, and/or alloys thereof; III-V semiconductors, such as GaAs, GaSb, GaP, GaN, AlSb, AlAs, AlP, AlN, InSb, InAs, InP, InN, and/or alloys thereof; II-VI semiconductors, such as ZnTe, ZnSe, ZnS, ZnO, CdSe, CdTe, CdS, MgSe, MgTe, MgS, and/or alloys thereof; and/or any other suitable semiconductors. The semiconductors can be doped and/or intrinsic. Doped semiconductors are preferably doped by low-diffusivity dopants, which can minimize dopant migration (e.g., at elevated temperatures). For example, n-type Si is preferably doped by P and/or Sb, but can additionally or alternatively be doped by As and/or any other suitable dopant, and p-type Si is preferably doped by In, but can additionally or alternatively be doped by Ga, Al, B, and/or any other suitable dopant. The semiconductors can be single-crystalline, poly-crystalline, micro-crystalline, amorphous, and/or have any other suitable crystallinity or mixture thereof (e.g., including micro-crystalline regions surrounded by amorphous regions).

The metals can include alkali metals (e.g., Li, Na, K, Rb, Cs, Fr), alkaline earth metals (e.g., Be, Mg, Ca, Sr, Ba, Ra), transition metals (e.g., Sc, Ti, V, Cr, Mn, Fe, Co, Ni, Cu, Zn, Sn, Zr, Nb, Mo, Au, Ru, Rh, Pd, Ag, Cd, Hf, Ta, W, Re, Ir, Pt, Hg, Ga, Tl, Pb, Bi, Sb, Te, Sm, Tb, Ce, Nd), post-transition metals (e.g., Al, Zn, Ga, Ge, Cd, In, Sn, Sb, Hg, Tl, Pb, Bi, Po, At), metalloids (e.g., B, As, Sb, Te, Po), rare earth elements (e.g., lanthanides, actinides), synthetic elements (e.g., Am, Cm, Bk, Cf, Es, Fm, Md, No, Lr, Rf, Db, Sg, Bh, Hs, Mt, Ds, Rg, Cn, Nh, Fl, Mc, Lv, Ts), any other suitable metal elements, and/or any suitable alloys, compounds, and/or other mixtures of the metal elements.

The insulators can include any suitable insulating (and/or wide-bandgap semiconducting) materials. For example, insulators can include insulating metal and/or semiconductor compounds, such as oxides, nitrides, carbides, oxynitrides, fluorides, borides, and/or any other suitable compounds.

The 2D materials can include any suitable 2D materials. For example, the 2D materials can include graphene, BN, metal dichalcogenides (e.g., MoS2, MoSe2, etc.), and/or any other suitable materials. However, the system can include any other suitable materials.

The elements of the system can include any suitable alloys, compounds, and/or other mixtures of materials (e.g., the materials described above, other suitable materials, etc.), in any suitable arrangements (e.g.; multilayers; superlattices; having microstructural elements such as inclusions, dendrites, lamina, etc.).

However, the system can additionally or alternatively include any other suitable elements, of any suitable compositions and/or functionalities, in any suitable arrangement.

2. Method.

Figure 7:
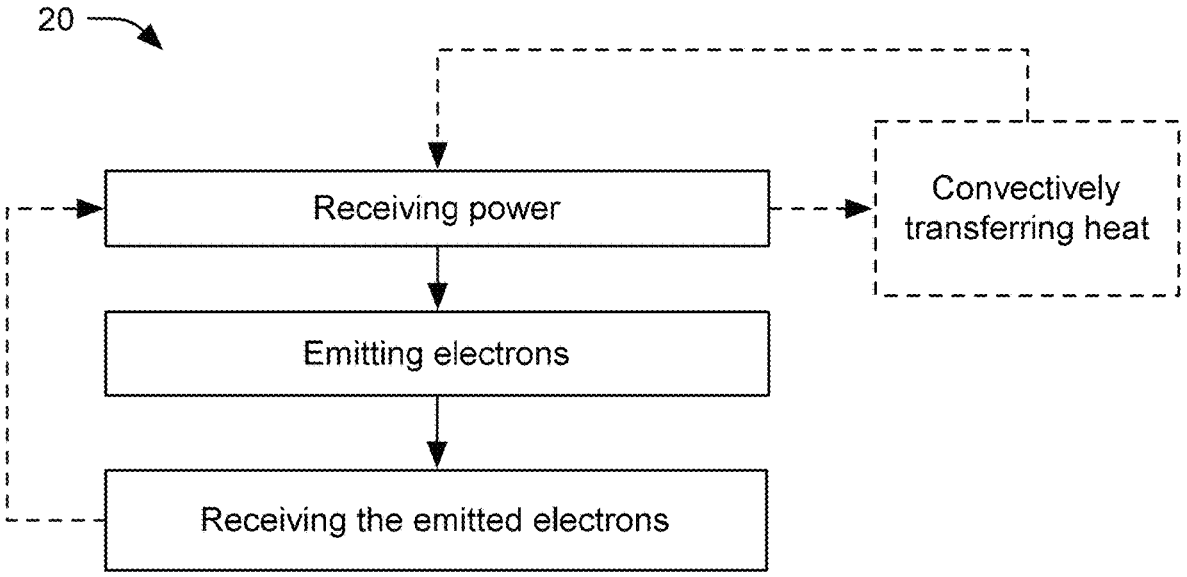
FIG. 7 is a schematic representation of a method for thermionic energy generation.

A method 20 for thermionic energy generation preferably includes receiving power, emitting electrons, and receiving the emitted electrons, and can optionally include convectively transferring heat and/or any other suitable elements (e.g., as shown in FIG. 7). The method is preferably performed using the system 10 for thermionic energy generation described above, but can additionally or alternatively be performed using any other suitable system(s).

The method for thermionic energy generation preferably functions to generate an electrical output (e.g., provide electrical power to an external load). The method preferably includes receiving power, emitting electrons, and receiving emitted electrons. The method can optionally include convectively transferring heat. However, the method can additionally or alternatively include any other suitable elements.

Receiving power is preferably performed within the heating cavity, more preferably near the electron emitter (e.g., at the inner shell, such as adjacent to the electron emitter). The power is preferably thermal power, but can additionally or alternatively include power from any other suitable source. The method can optionally include providing the received power. The power is preferably provided by the power input. The power is preferably provided continuously but can alternatively be provided with any other suitable timing. In one example, providing power includes operating a burner (e.g., arranged within the heating cavity) with one or more flames close to and/or incident upon the flame-reception region of the emitter module, wherein receiving powder includes receiving heat from the flame at the flame-reception region. However, receiving power can additionally or alternatively include any other suitable elements performed in any suitable manner.

Emitting electrons is preferably performed at (and/or near) the electron emitter. In response to receiving power (e.g., in response to the electron emitter reaching an elevated temperature, such as greater than a temperature within the range 400-500, 500-600, 600-700, 700-800, 800-1000, 1000-1600, or 1600-2000° C., etc.), the electron emitter preferably emits electrons (e.g., thermionically emits electrons). The electrons are preferably emitted into the chamber, more preferably toward the electron collector. However, emitting electrons can additionally or alternatively include any other suitable elements performed in any suitable manner.

Receiving emitted electrons is preferably performed at the electron collector. The electrons are preferably received from the electron emitter via the chamber. While receiving emitted electrons, the electron collector preferably has a lower temperature (and optionally has a lower work function) than the electron emitter, which can result in generation of electrical power from receipt of the emitted electrons. Receiving emitted electrons preferably includes providing the generated electrical power to an external electrical load (e.g., via conductive leads of the emitter and collector modules). However, receiving emitted electrons can additionally or alternatively include any other suitable elements performed in any suitable manner.

The method can optionally include convectively transferring heat. Convectively transferring heat can function to cool the electron collector and/or preheat burner gases. Convectively transferring heat is preferably performed by the airflow module, which can cause one or more fluids (e.g., air) to flow along elements of the system (e.g., along an airflow path defined by one or more ducts of the airflow module). The elements of the system that the fluid can flow along can include one or more of the cooling element, emitter module outer shell, emitter module inner shell, burner, and/or any other suitable elements. However, convectively transferring heat can additionally or alternatively include any other suitable elements performed in any suitable manner, and/or the method can additionally or alternatively include any other suitable elements performed in any suitable manner.

Although omitted for conciseness, the preferred embodiments include every combination and permutation of the various system components and the various method processes. Furthermore, various processes of the preferred method can be embodied and/or implemented at least in part as a machine configured to receive a computer-readable medium storing computer-readable instructions. The instructions are preferably executed by computer-executable components preferably integrated with the system. The computer-readable medium can be stored on any suitable computer readable media such as RAMs, ROMs, flash memory, EEPROMs, optical devices (CD or DVD), hard drives, floppy drives, or any suitable device. The computer-executable component is preferably a general or application specific processing subsystem, but any suitable dedicated hardware device or hardware/firmware combination device can additionally or alternatively execute the instructions.

The FIGURES illustrate the architecture, functionality and operation of possible implementations of systems, methods and computer program products according to preferred embodiments, example configurations, and variations thereof. In this regard, each block in the flowchart or block diagrams may represent a module, segment, step, or portion of code, which comprises one or more executable instructions for implementing the specified logical function(s). It should also be noted that, in some alternative implementations, the functions noted in the block can occur out of the order noted in the FIGURES. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

As a person skilled in the art will recognize from the previous detailed description and from the figures and claims, modifications and changes can be made to the preferred embodiments of the invention without departing from the scope of this invention defined in the following claims.

We claim:

1. A system comprising a thermionic energy converter (TEC) defining a chamber, wherein the TEC comprises:
- a collector module comprising an electron collector;
- an emitter module comprising:
  - an electron emitter opposing the electron collector across the chamber;
  - an inner member defining a heating cavity, wherein the heating cavity opposes the chamber across the electron emitter and across the inner member; and
  - an outer member opposing the inner member across the chamber, the outer member electrically connected to the electron emitter via the inner member; and
- a seal comprising an electrical insulator, the seal arranged between the outer member and the collector module, wherein the seal mechanically connects the outer member to the collector module.

2. The system of claim 1, wherein:
- the electron collector defines a collector surface bounding the chamber, wherein the collector surface is substantially planar;
- the electron emitter defines an emitter surface bounding the chamber, wherein the emitter surface is substantially planar; and
- the collector surface opposes the emitter surface across the chamber.

3. The system of claim 2, wherein the collector surface is substantially parallel to the emitter surface.

4. The system of claim 2, wherein:
- the TEC further comprises a spacer arranged within the chamber between the emitter surface and the collector surface;
- the spacer substantially maintains a gap between the emitter surface and the collector surface; and
- the spacer does not electrically connect the electron emitter to the electron conductor.

5. The system of claim 4, wherein:
- a pressure within the chamber is less than an ambient pressure of an ambient environment surrounding the system; and
- the ambient pressure forces at least one of the electron collector or the electron emitter toward the spacer, such that both the collector surface and the emitter surface contact the spacer.

6. The system of claim 5, wherein:
- the collector module further comprises a bridge, the bridge comprising a deformable element; and
- the electron collector is mechanically coupled to the seal via the bridge.

7. The system of claim 6, wherein the deformable element comprises a metal foil.

8. The system of claim 6, wherein the deformable element defines a corrugated structure.

9. The system of claim 6, wherein:
- the electron collector comprises an n-type semiconductor; and
- the bridge comprises a metal.

10. The system of claim 9, wherein the n-type semiconductor comprises silicon.

11. The system of claim 1, wherein the TEC defines:

a central axis, wherein the central axis intersects the electron emitter, the electron collector, the chamber, and the cavity; and a transverse vector normal to, originating at, and oriented outward from the central axis;

wherein:

the transverse vector intersects the inner member at a first point;

the transverse vector intersects the outer member at a second point, wherein the first point is arranged between the central axis and the second point;

the transverse vector intersects the chamber at a third point between the first and second points; and in response to operating the TEC in an operation mode, comprising heating the electron emitter and cooling the electron collector, the first point attains a first temperature and the second point attains a second temperature substantially lower than the first temperature.

12. The system of claim 11, further comprising:

a first lead conductively coupling the electron collector to an electrical load; and a second lead conductively coupling the electron emitter to the electrical load via the inner member and the outer member;

wherein, in response to operating the TEC in the operation mode, the TEC electrically drives the electrical load via the first and second leads.

13. The system of claim 1, wherein:

the emitter module defines an electrically conductive path from the electron emitter to the seal via the inner member and the outer member; and when operating the TEC in an operation mode, comprising heating the electron emitter and cooling the electron collector, an emitter module temperature monotonically decreases along the electrically conductive path.

14. The system of claim 13, wherein, when operating the TEC in the operation mode, an emitter temperature of the electron emitter is greater than 500° C.

15. The system of claim 1, further comprising a burner arranged within the heating cavity, wherein the burner heats the electron emitter.

16. The system of claim 15, wherein:

the electron emitter is affixed to and thermally coupled to a heat-reception region of the inner member, wherein the electron emitter is arranged between the chamber and the heat-reception region; and the recuperating burner emits heat within the heating cavity, thereby heating the electron emitter via the heat-reception region.

17. The system of claim 1, further comprising:

a cooling element thermally coupled to the electron collector; and a duct defining an airflow path from the cooling element to the heating cavity, wherein:

the outer shell is arranged between the duct and the heating cavity; and the duct thermally couples air within the duct to the outer shell.

18. The system of claim 17, further comprising a burner arranged within the heating cavity, wherein:

the outer member preheats the air within the duct;

the duct delivers the preheated air to the burner; and the burner combusts fuel with the preheated air, thereby heating the electron emitter.

19. The system of claim 1, wherein the outer shell comprises a heat pipe thermally coupling the seal to the inner shell.

20. The system of claim 1, wherein the chamber is substantially bounded by the electron emitter, the inner member, the outer member, the seal, and the collector module.

* * * * *